US012778365B2

(12) United States Patent
Thorne et al.

(10) Patent No.: US 12,778,365 B2
(45) Date of Patent: Nov. 3, 2026

(54) CLEANING HEAD FOR A SURFACE TREATMENT APPARATUS HAVING ONE OR MORE STABILIZERS AND SURFACE TREATMENT APPARATUS HAVING THE SAME

(71) Applicant: SharkNinja Operating, LLC, Needham, MA (US)

(72) Inventors: Jason B. Thorne, Dover, MA (US); Kai Xu, Suzhou (CN); Zongnan Cheng, Suzhou (CN); Ian Liu, Suzhou (CN); AiMing Xu, Suzhou (CN); Wenxiu Gao, Suzhou (CN); Andre D. Brown, Natick, MA (US); Samuel Emrys James, London (GB); Jordan Ridgley, High Wycombe (GB); Nicholas Sardar, London (GB); Christopher P. Pinches, Surrey (GB); David S. Clare, London (GB); Lee M. Cottrell, Edenbridge (GB)

(73) Assignee: SharkNinja Operating LLC, Needham, MA (US)

( * ) Notice: Subject to any disclaimer, the term of this patent is extended or adjusted under 35 U.S.C. 154(b) by 282 days.

(21) Appl. No.: 18/763,290

(22) Filed: Jul. 3, 2024

(65) Prior Publication Data

US 2025/0031925 A1 Jan. 30, 2025

Related U.S. Application Data

(63) Continuation of application No. 16/575,891, filed on Sep. 19, 2019, now Pat. No. 12,053,140.

(Continued)

(51) Int. Cl.

*A47L 9/04* (2006.01)
*A47L 9/00* (2006.01)

(52) U.S. Cl.

CPC ..... *A47L 9/0455* (2013.01); *A47L 9/0054* (2013.01); *A47L 9/009* (2013.01)

(58) Field of Classification Search

CPC ..... A47L 9/0455; A47L 9/0054; A47L 9/009; A47L 5/28

See application file for complete search history.

(56) References Cited

U.S. PATENT DOCUMENTS 1,983,567 A * 12/1934 Daniel ..... A47L 9/00 15/336
2,120,011 A * 6/1938 Martinet ..... A47L 5/34 116/266

(Continued)

FOREIGN PATENT DOCUMENTS

CN 2303758 1/1999
CN 2324840 6/1999

(Continued)

OTHER PUBLICATIONS

PCT Search Report and Written Opinion mailed Dec. 11, 2019, received in PCT Application No. PCT/US19/51889, 9 pgs.

(Continued)

*Primary Examiner* — Marc Carlson
(74) *Attorney, Agent, or Firm* — Secant IP, P.L.L.C.

(57) ABSTRACT

An example of a surface cleaning head may include a main body, a neck pivotally coupled to the main body, a stabilizer, and a linkage pivotally coupled to the main body and the stabilizer. The linkage may be configured to cause the stabilizer to transition between an extended position and a retracted position in response to a pivotal movement of the neck.

20 Claims, 31 Drawing Sheets

Related U.S. Application Data

(60) Provisional application No. 62/862,436, filed on Jun. 17, 2019, provisional application No. 62/733,239, filed on Sep. 19, 2018.

(56) References Cited

U.S. PATENT DOCUMENTS 2,784,441 A * 3/1957 Kaufman ..... A47L 5/32 280/43.16
3,939,518 A * 2/1976 Whitney ..... A47L 11/4055 15/98
4,156,952 A * 6/1979 Lynch, Jr. ..... A47L 11/4088 15/381
4,513,472 A * 4/1985 Wells ..... A47L 9/009 15/354
5,101,615 A 4/1992 Fassauer
5,850,666 A 12/1998 Farone et al.
6,098,242 A 8/2000 Choi
6,173,474 B1 1/2001 Conrad
6,256,833 B1 * 7/2001 Steinberg ..... A47L 5/28 15/325
6,311,366 B1 11/2001 Sepke et al.
7,823,251 B2 11/2010 Dyson et al.
RE42,155 E 2/2011 Ragner
8,151,408 B2 4/2012 Finke et al.
8,281,456 B2 10/2012 Finke
8,365,351 B2 2/2013 Windmeisser
8,429,791 B2 * 4/2013 White ..... A47L 5/32 15/411
8,991,005 B2 * 3/2015 Mersmann ..... A47L 9/009 15/354
9,622,630 B2 4/2017 Faremo et al.
2001/0018780 A1 * 9/2001 Hashizume ..... A47L 5/28 15/351
2005/0235454 A1 10/2005 Courtney
2006/0207054 A1 9/2006 Loebig
2008/0115313 A1 * 5/2008 Dyson ..... A47L 9/0054 15/411
2009/0056064 A1 3/2009 Finke et al.
2009/0056065 A1 3/2009 Finke
2009/0064449 A1 * 3/2009 Newton ..... A47L 5/32 15/354
2009/0064450 A1 * 3/2009 Newton ..... A47L 9/0054 15/300.1
2009/0089969 A1 4/2009 Lee et al.
2009/0165242 A1 * 7/2009 Lee ..... A47L 9/242 15/411
2010/0088842 A1 * 4/2010 Worker ..... A47L 9/009 15/353
2011/0094054 A1 4/2011 Dos Reis et al.
2012/0233806 A1 9/2012 Streciwilk
2013/0058635 A1 3/2013 Vrdoljak
2013/0152337 A1 6/2013 Thorne
2014/0150201 A1 6/2014 Mcgee et al.
2014/0237752 A1 8/2014 Conrad
2014/0259520 A1 9/2014 Sutrina
2015/0013102 A1 1/2015 Bilger
2015/0040340 A1 2/2015 Bilger et al.
2015/0067981 A1 * 3/2015 Faremo ..... A47L 9/32 15/354
2015/0135474 A1 5/2015 Gidwell
2015/0297054 A1 10/2015 Weeks et al.
2015/0351596 A1 12/2015 Thorne
2016/0128530 A1 5/2016 Thorne et al.
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0324388 A1 11/2016 Vrdoljak et al.
2016/0374533 A1 12/2016 Innes et al.
2017/0042319 A1 2/2017 Conrad et al.
2017/0112343 A1 4/2017 Innes et al.
2017/0127896 A1 5/2017 Carter et al.
2017/0144810 A1 5/2017 Birdsell
2017/0215667 A1 8/2017 Thorne et al.
2017/0347848 A1 12/2017 Carter et al.
2018/0035854 A1 2/2018 Thorne
2018/0064301 A1 3/2018 Cottrell et al.
2018/0068815 A1 3/2018 Cottrell
2018/0070785 A1 3/2018 Udy et al.
2018/0255991 A1 9/2018 Der Marderosian et al.
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1 3/2019 Tonderys et al.
2019/0090705 A1 3/2019 Thorne et al.
2019/0191947 A1 6/2019 Freese et al.
2019/0193120 A1 6/2019 Brown et al.
2019/0246853 A1 8/2019 Sardar et al.
2019/0274500 A1 9/2019 Thorne et al.
2019/0274501 A1 9/2019 Antonisami et al.
2019/0302793 A1 10/2019 Leech et al.
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2020/0000298 A1 1/2020 Brown et al.
2020/0022543 A1 1/2020 Gill et al.
2020/0022544 A1 1/2020 Gill et al.
2020/0022553 A1 1/2020 Gill et al.
2020/0037833 A1 2/2020 Noedzweclo et al.
2020/0037843 A1 2/2020 Fiebig et al.
2020/0046184 A1 2/2020 Freese et al.
2020/0077855 A1 * 3/2020 Brown ..... A47L 9/2842
2020/0085267 A1 * 3/2020 Thorne ..... A47L 9/0054
2020/0085269 A1 3/2020 Thorne
2020/0121144 A1 4/2020 Gacin et al.
2020/0121148 A1 4/2020 Hoffman et al.
2020/0138260 A1 5/2020 Sutter et al.
2020/0166949 A1 5/2020 Leech et al.
2020/0170470 A1 6/2020 Liggett et al.
2020/0201348 A1 6/2020 Leech
2020/0205631 A1 7/2020 Brown et al.
2020/0205634 A1 7/2020 Sutter et al.
2020/0237171 A1 7/2020 Xu et al.
2020/0288929 A1 9/2020 Brunner
2020/0288930 A1 9/2020 Wells
2020/0297172 A1 9/2020 Tonderys et al.
2020/0301430 A1 9/2020 Irkliy et al.
2020/0315418 A1 10/2020 Howard et al.
2020/0345196 A1 11/2020 Innes et al.
2020/0367711 A1 11/2020 Thorne et al.
2020/0371526 A1 11/2020 Kamada et al.
2020/0383547 A1 12/2020 Sutter et al.
2021/0007569 A1 1/2021 Howard et al.
2021/0022574 A1 1/2021 Harting
2021/0030227 A1 2/2021 Mathieu et al.
2021/0038032 A1 2/2021 Brown
2021/0059495 A1 3/2021 Gill et al.
2021/0085144 A1 3/2021 Woodrow et al.
2021/0169289 A1 6/2021 Thorne et al.
2021/0175772 A1 6/2021 Aini
2021/0177223 A1 6/2021 Der Marderosian et al.
2021/0186282 A1 6/2021 Mathieu et al.
2021/0254615 A1 8/2021 Vrdoljak et al.
2021/0307581 A1 10/2021 Thorne et al.
2022/0071459 A1 3/2022 Gacin et al.
2022/0095864 A1 3/2022 Der Marderosian et al.
2023/0248192 A1 8/2023 Brown et al.
2025/0031925 A1 * 1/2025 Thorne ..... A47L 9/009

FOREIGN PATENT DOCUMENTS

CN 101116770 2/2008
CN 100539920 9/2009
CN 100539920 C * 9/2009

(56) References Cited

FOREIGN PATENT DOCUMENTS

| | | | | | |
|---|---|---|---|---|---|
| CN | 102038457 | | | 5/2011 | |
| CN | 104271020 | | | 1/2015 | |
| CN | 104271020 | A | * | 1/2015 | A47L 9/32 |
| DE | 3834686 | | | 12/1989 | |
| DE | 10141088 | C1 | * | 4/2003 | A47L 9/0054 |
| DE | 202008017137 | | | 4/2009 | |
| DE | 102011001631 | | | 10/2011 | |
| EP | 1591052 | A2 | * | 11/2005 | A47L 5/14 |
| EP | 1591052 | | | 8/2007 | |
| EP | 2055219 | | | 5/2009 | |
| EP | 1758493 | | | 12/2009 | |
| GB | 2304549 | | | 3/1997 | |
| GB | 2290462 | | | 10/1997 | |
| GB | 2422094 | A | * | 7/2006 | A47L 5/28 |
| GB | 2452548 | A | * | 3/2009 | A47L 9/009 |
| GB | 2452549 | A | * | 3/2009 | A47L 9/009 |
| JP | 60194919 | | | 10/1985 | |
| JP | 61012461 | | | 1/1986 | |
| JP | 62151835 | | | 9/1987 | |
| JP | 02172427 | | | 7/1990 | |
| JP | 02234733 | | | 9/1990 | |
| JP | 03003956 | | | 1/1991 | |
| JP | 03004825 | | | 1/1991 | |
| JP | 07322972 | | | 12/1995 | |
| JP | 2000116574 | | | 4/2000 | |
| JP | 2000116574 | A | * | 4/2000 | |
| JP | 2003102663 | | | 4/2003 | |
| JP | 2003102663 | A | * | 4/2003 | |
| JP | 04258730 | | | 4/2009 | |
| KR | 100774508 | | | 11/2007 | |
| KR | 100774508 | B1 | * | 11/2007 | A47L 5/28 |
| KR | 101003601 | | | 12/2010 | |
| KR | 101052161 | | | 7/2011 | |
| KR | 1020120004104 | | | 1/2012 | |
| KR | 1020120014326 | | | 2/2012 | |
| KR | 1020120016810 | | | 2/2012 | |
| WO | 2005034706 | | | 4/2005 | |
| WO | 2008142642 | | | 11/2008 | |

OTHER PUBLICATIONS

Chinese Office Action with English translation issued Dec. 10, 2021, received in Chinese Patent Application No. 201980074896.9, 11 pages.

Australian Examination Report issued Feb. 23, 2022, received in Australian Patent Application No. 2019342737, 3 pages.

Korean Office Action with English translation issued May 20, 2022, received in Korean Patent Application No. 10-2021-7011620, 15 pages.

Extended European Search Report issued May 27, 2022, received in European Patent Application No. 19863315.8, 8 pages.

Japanese Office Action with English translation mailed Jun. 1, 2022, received in Japanese Patent Application No. 2021-515189, 7 pages.

Canadian Examination Report issued Jun. 27, 2022, received in Canadian Patent Application No. 3,113,028, 3 pages.

Chinese Office Action with English Summary issued Dec. 6, 2022, received in Chinese Patent Application No. 2019800748969, 11 pages.

* cited by examiner

CLEANING HEAD FOR A SURFACE TREATMENT APPARATUS HAVING ONE OR MORE STABILIZERS AND SURFACE TREATMENT APPARATUS HAVING THE SAME

CROSS-REFERENCE TO RELATED APPLICATIONS

The present application is a continuation of U.S. application Ser. No. 16/575,891 filed on Sep. 19, 2019, which claims the benefit of U.S. Provisional Application Ser. No. 62/733,239 filed on Sep. 19, 2018, entitled Cleaning Head for a Surface Treatment Apparatus having one or more Stabilizers and Surface Treatment Apparatus having the same and of U.S. Provisional Application Ser. No. 62/862,436 filed on Jun. 17, 2019, entitled Cleaning Head for a Surface Treatment Apparatus having one or more Stabilizers and Surface Treatment Apparatus having the same, all of which are fully incorporated herein by reference.

TECHNICAL FIELD

The present disclosure is generally directed to surface treatment apparatuses and more specifically to a cleaning head for a surface treatment apparatus having one or more stabilizers.

BACKGROUND INFORMATION

Surface treatment apparatuses may include vacuum cleaners configured to suction debris from a surface (e.g., a floor). The vacuum cleaner may include a surface cleaning head having one or more brush rolls configured to agitate a surface (e.g., a carpet) to urge debris into an airflow generated by the vacuum cleaner. The debris within the airflow may then be deposited in a debris collector for later disposal.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a surface treatment apparatus having an upright portion and a surface cleaning head pivotally coupled to the upright portion. The upright portion is transitionable between an in-use position and a storage position by pivoting the upright portion relative to the surface cleaning head. The surface cleaning head includes at least one stabilizer configured to transition from an extended position to a retracted position in response to, for example, transitioning the upright portion between the storage position and the in-use position. The stabilizer may improve the stability of the surface treatment apparatus when, for example, the surface treatment apparatus is not in-use without substantially interfering with the usage of the surface treatment apparatus. This may prevent the surface treatment apparatus from inadvertently tipping over and causing damage to, for example, itself, other objects, an animal, and/or a person.

Figure 1:
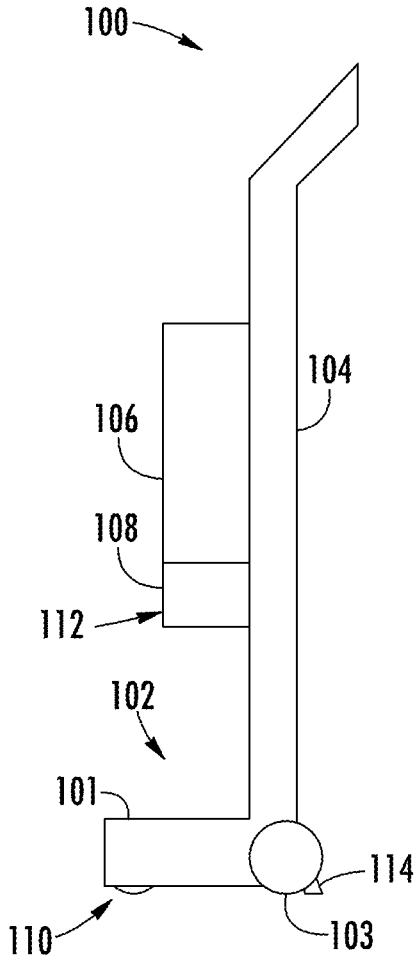
FIG. 1 shows a schematic view of a vacuum cleaner in a storage position, consistent with embodiments of the present disclosure.

FIG. 1 shows a schematic view of a vacuum cleaner 100 including a surface cleaning head 102 having one or more wheels 103 rotatably coupled thereto, an upright section 104, a dust cup 106, and a suction motor 108. The suction motor 108 is configured generate an airflow into an inlet 110 of the surface cleaning head 102 such that debris can be suctioned from a surface to be cleaned (e.g., a floor). At least a portion of debris that is entrained within the airflow is deposited in the dust cup 106 for later disposal by a user of the vacuum cleaner 100. After passing through the dust cup 106, the airflow is exhausted from the suction motor 108 at an exhaust outlet 112. The suction motor 108 can be powered by, for example, one or more batteries and/or an electrical grid.

As shown in FIG. 1, the upright section 104 is in a storage (or upright) position. The upright section 104 is pivotally coupled to a main body 101 of the surface cleaning head 102 such that the upright section 104 can be pivoted to an in-use (or reclined) position (e.g., as shown FIG. 2). An axis about which the upright section 104 pivots when transitioning between the storage and in-use positions can extend substantially parallel to an axis about which the one or more wheels 103 rotate.

Figure 2:
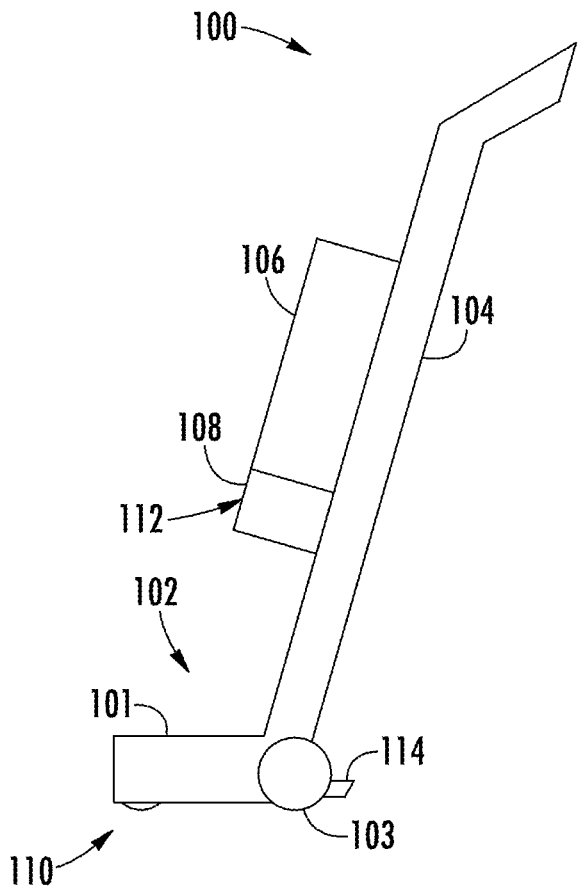
FIG. 2 shows a schematic view of the vacuum cleaner of FIG. 1 in an in-use position, consistent with embodiments of the present disclosure.

One or more stabilizers 114 can be provided that are configured to transition between an extended (e.g., as shown in FIG. 1) and retracted (e.g., as shown in FIG. 2) position in response to, for example, the upright section 104 transitioning between the storage and in-use positions and/or in response to a user interaction. The stabilizer 114 can be configured to extend from the vacuum cleaner 100 and engage (e.g., contact) a surface (e.g., a floor) when the upright section 104 is in the storage position. Such a configuration may improve the stability of the vacuum cleaner 100 when compared to a vacuum cleaner 100 that does not include the stabilizer 114.

As the upright section 104 is pivoted towards the in-use position, the stabilizer 114 can move towards the retracted position for at least a portion of the pivotal movement such that the stabilizer 114 does not substantially interfere with the use of the vacuum cleaner 100. As such, the surface cleaning head 102 can be moved across a surface to be cleaned (e.g., a floor) without the stabilizer 114 engaging (e.g., contacting) the surface to be cleaned. In other words, the stability of the vacuum cleaner 100 can be improved without substantially interfering with the maneuverability of the vacuum cleaner 100.

Figure 3:
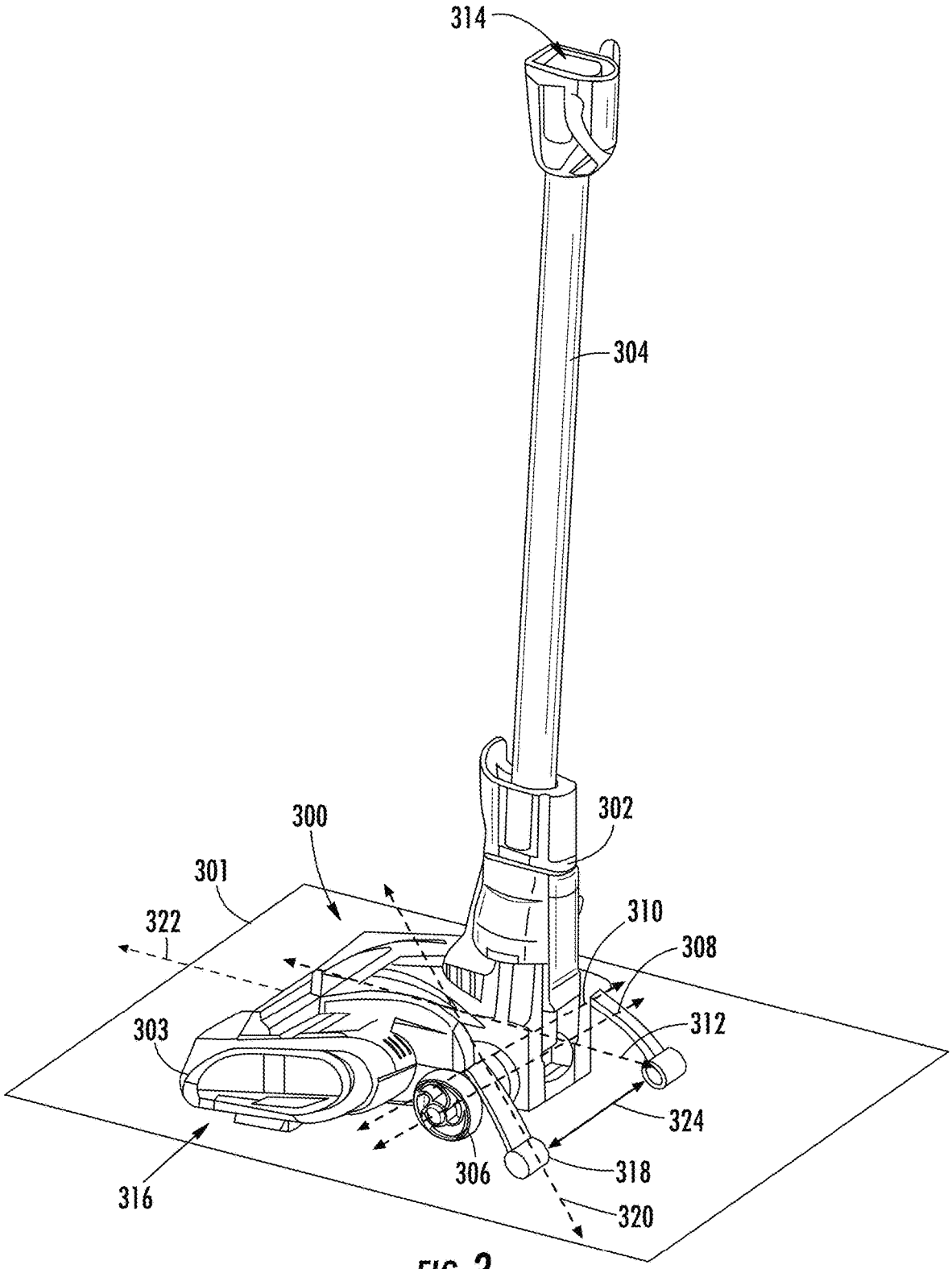
FIG. 3 shows a perspective view of a surface cleaning head coupled to a wand, wherein the wand is in a storage position, consistent with embodiments of the present disclosure.

FIG. 3 shows a perspective view of a surface cleaning head 300, which may be an example of the surface cleaning head 102 of FIG. 1. As shown, the surface cleaning head 300 includes a neck 302 pivotally coupled to a main body 303 of the surface cleaning head 300. The neck 302 is configured to receive a wand 304 such that the neck 302 and the wand 304 can be described as collectively forming at least a portion of an upright section of a vacuum cleaner such as, for example, the vacuum cleaner 100 of FIG. 1. As also shown, the surface cleaning head 300 can include one or more main wheels 306 that are configured to rotate about a rotation axis 308 in response to the surface cleaning head 300 being urged across a surface to be cleaned 301 (e.g., a floor).

Figure 4:
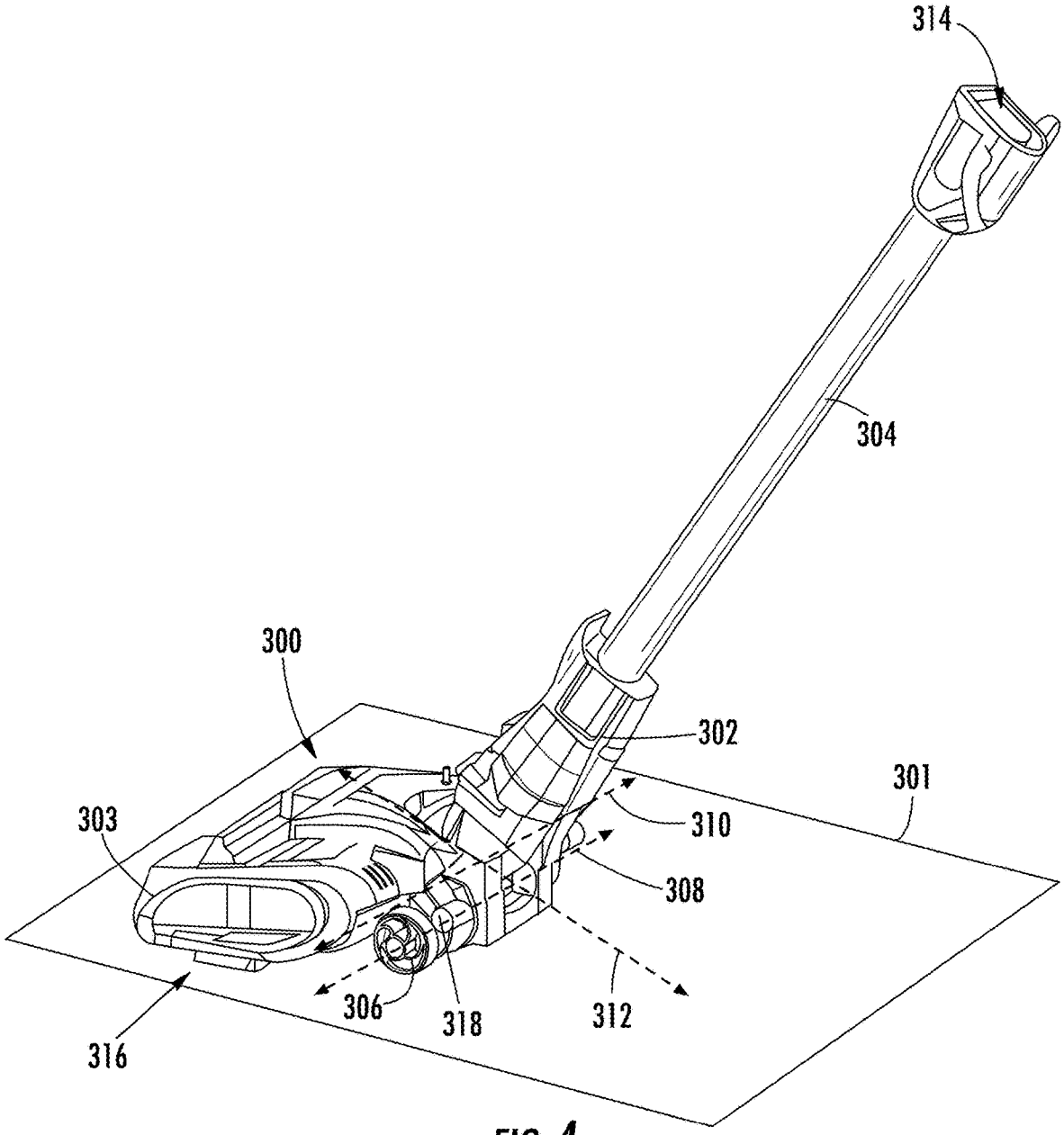
FIG. 4 shows a perspective view of the surface cleaning head of FIG. 3 having the wand in an in-use position, consistent with embodiments of the present disclosure.

The neck 302 can be configured to pivot about one or more axes. For example, the neck 302 can be configured to pivot about a first pivot axis 310 that extends substantially parallel to the rotation axis 308 of the one or more wheels 306. As such, the neck 302 and the wand 304 can be transitioned between a storage position (e.g., as shown in FIG. 3) and an in-use position (e.g., as shown in FIG. 4) in response to pivoting about the first pivot axis 310. Additionally, or alternatively, the neck 302 can be configured to pivot side-to-side about a second pivot axis 312 that extends transverse to (e.g., perpendicular to) the rotation axis 308 of the one or more wheels 306. Such a configuration may allow the surface cleaning head 300 to be more easily maneuvered.

The wand 304 can define a fluid channel 314 such that air drawn into the surface cleaning head 300 through an air inlet 316 can pass through the wand 304. In other words, the wand 304 can be fluidly coupled to the surface cleaning head 300. In some instances, the wand 304 can be removably coupled to the neck 302 such that the wand 304 can be used independently of the surface cleaning head 300 (e.g., the wand 304 may be configured to couple to a surface cleaning accessory).

As shown, the surface cleaning head 300 includes at least one stabilizer 318 configured to transition between an extended position (e.g., as shown in FIG. 3) in which the stabilizer 318 engages (e.g., contacts) the surface to be cleaned 301 and a retracted position (e.g., as shown in FIG. 4) in which the stabilizer 318 is configured to be disengaged from the surface to be cleaned 301. The stabilizer 318 is configured to transition between the extended position and the retracted position in response to, for example, the neck 302 being pivoted between the storage position and the in-use position.

For example, when the neck 302 is transitioned from the storage position towards the in-use position, the stabilizer 318 can transition from the extended position to the retracted position. As such, the stabilizer 318 should not substantially interfere with the movement of the surface cleaning head 300 across a surface to be cleaned 301 when the neck 302 is in the in-use position. By way of further example, when the neck 302 is transitioned from the in-use position to the storage position, the stabilizer 318 can transition from the retracted position to the extended position. As such, when the neck 302 is in the storage position, the stabilizers 318 can improve the stability of the surface cleaning head 300 such that, for example, it is less likely to tip over.

In some instances, the stabilizer 318 can include one or more wheels coupled thereto (e.g., the at least one wheel 306 and/or an additional wheel). For example, when the stabilizer 318 is in the extended position, the one or more wheels can be configured to engage (e.g., contact) the surface to be cleaned 301 such that the wheels can rollingly engage the surface to be cleaned 301.

In some instances, the stabilizer 318 can be configured to extend or retract for only a portion of the pivotal movement of the neck 302. For example, the stabilizer 318 can begin to extend when the neck 302 is being transitioned towards the storage position and when the neck 302 is within a predetermined number of degrees (e.g., 2°, 5°, 7°, 10°, 15°, and/or any other suitable number of degrees) of the storage position. In other words, the stabilizer 318 can be configured to transition between extended and retracted positions in response to the neck 302 pivoting within a predetermined range.

As shown, when the stabilizer 318 is in the extended position, the stabilizer 318 extends behind the one or more wheels 306 such that the one or more wheels 306 are disposed between at least a portion of the stabilizer 318 and the air inlet 316 of the surface cleaning head 300. Additionally, or alternatively, when the stabilizer 318 is in the extended position, the wand 304 can be positioned between the main body 303 of the surface cleaning head 300 and a distal most portion of the stabilizer 318 (e.g., a portion of the stabilizer 318 configured to engage the surface to be cleaned 301).

When the stabilizer 318 is in the retracted position, at least a portion of the stabilizer 318 can transition into a cavity defined within the main body 303 of the surface cleaning head 300 such that the one or more wheels 306 are disposed between the surface to be cleaned 301 and at least a portion of the stabilizer 318.

As also shown, in some instances, a plurality of stabilizers 318 can be provided. In these instances, a longitudinal axis 320 of each stabilizer 318 extends transverse to a forward movement direction 322 of the surface cleaning head 300. In other words, the longitudinal axes 320 extend transverse to each other. As a result, a separation distance 324 extending between the stabilizers 318 increases as the stabilizers 318 approach the surface to be cleaned 301 such that the stability of the surface cleaning head 300 may be improved. In other instances, the longitudinal axes 320 can extend parallel to each other and/or the forward movement direction 322.

Figure 5:
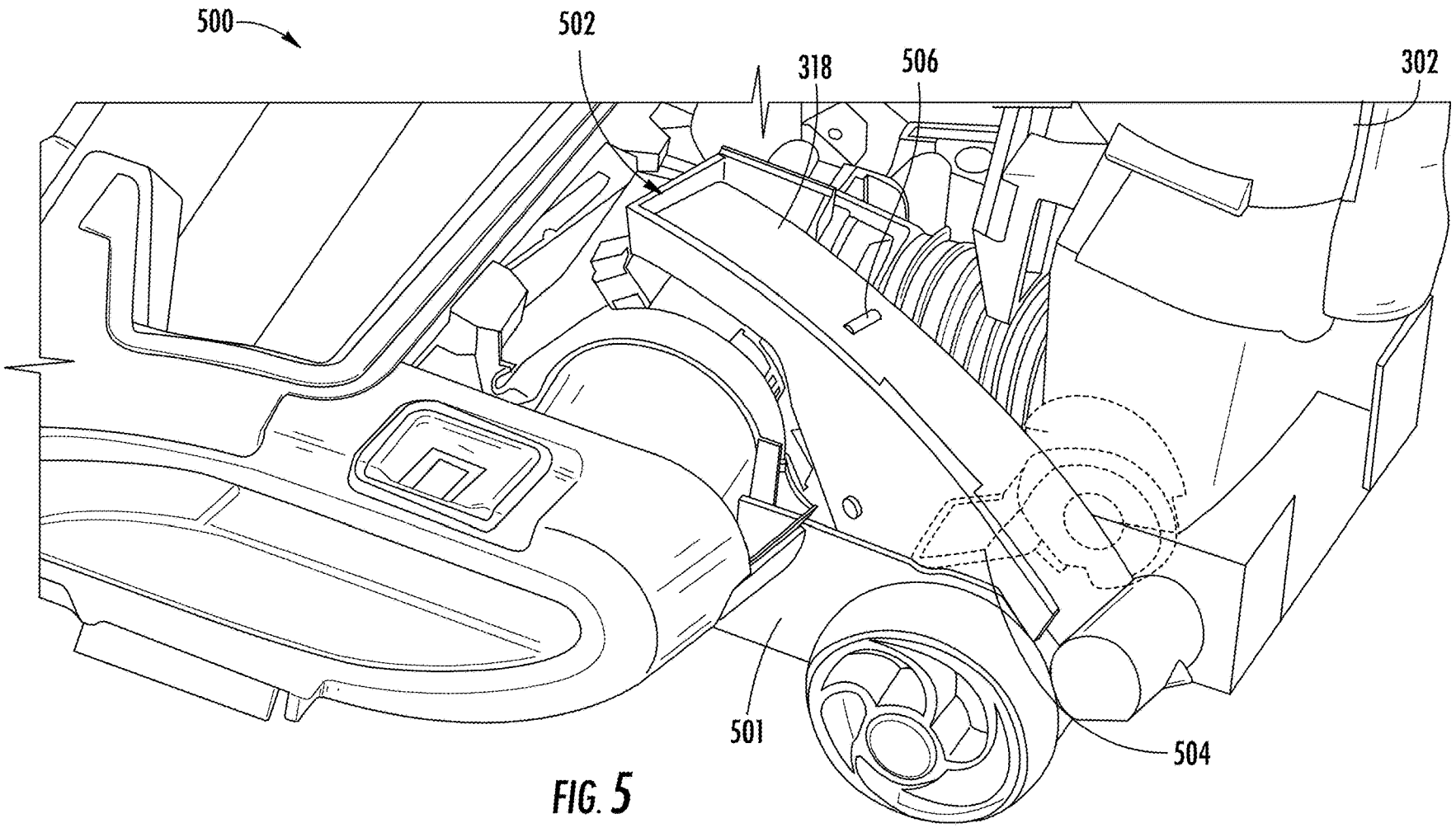
FIG. 5 shows a perspective cutaway view of an example of the surface cleaning head of FIG. 3, consistent with embodiments of the present disclosure.

FIG. 5 shows a perspective view of an example of a surface cleaning head 500, which may be an example of the surface cleaning head 300 of FIG. 3 having a portion of a top cover removed therefrom for purposes of illustration. As shown, a main body 501 of the surface cleaning head 500 defines a cavity 502 for receiving at least a portion of the stabilizer 318. The stabilizer 318 can be configured to slideably engage the cavity 502 such that, in response to transitioning the neck 302 between the storage position and the in-use position, the stabilizer 318 slides within the cavity 502.

Figure 6:
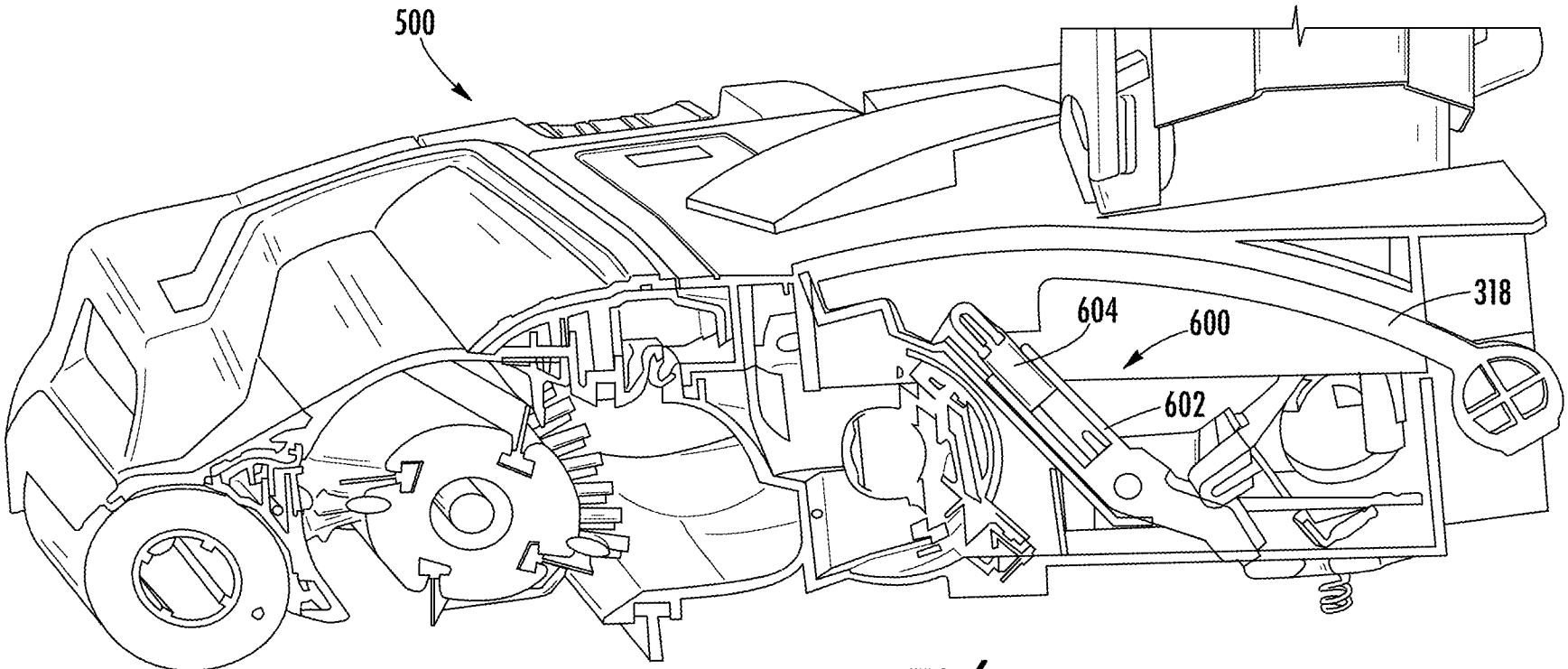
FIG. 6 shows a cross-sectional view of the surface cleaning head of FIG. 5, consistent with embodiments of the present disclosure.

For example, the surface cleaning head 500 may include a protrusion 504 (shown in hidden lines) configured to urge the stabilizer 318 between the extended and retracted position. For example, the protrusion 504 can extend from the neck 302. The protrusion 504 can be configured to rotate in response to transitioning the neck 302 between the storage and in-use positions. As shown in FIG. 6, the protrusion 504 can be coupled to a linkage 600 that is configured to engage (e.g., contact) the stabilizer 318. The linkage 600 can be pivotally coupled to the protrusion 504 such that, as the protrusion 504 is rotated in response to the transitioning of the neck 302 between the in-use and storage positions, the linkage 600 urges the stabilizer 318 to transition between the retracted and extended positions. As shown, the linkage 600 can include a pivot arm 602 and a plunger 604 slidably disposed therein such that, as the linkage 600 pivots, the plunger 604 slides within the pivot arm 602. In some instances, a biasing mechanism (e.g., a spring) can be provided to urge the plunger 604 into engagement with the stabilizer 318.

As also shown in FIG. 5, the stabilizer 318 can include a rib 506 that is configured to retain the stabilizer 318 in the extended position until the neck 302 is transitioned towards the storage position. For example, the rib 506 can be configured to engage (e.g., contact) a detent.

Figure 7:
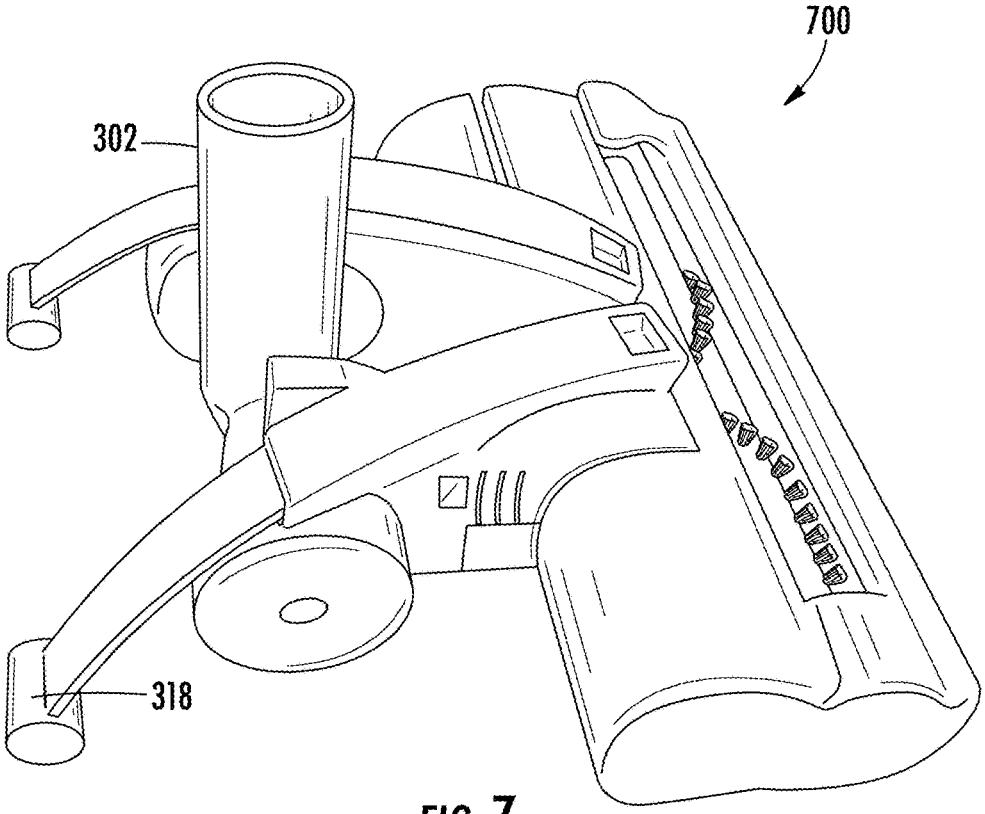
FIG. 7 shows a perspective view of another example of the surface cleaning head of FIG. 3, consistent with embodiments of the present disclosure.
Figure 8:
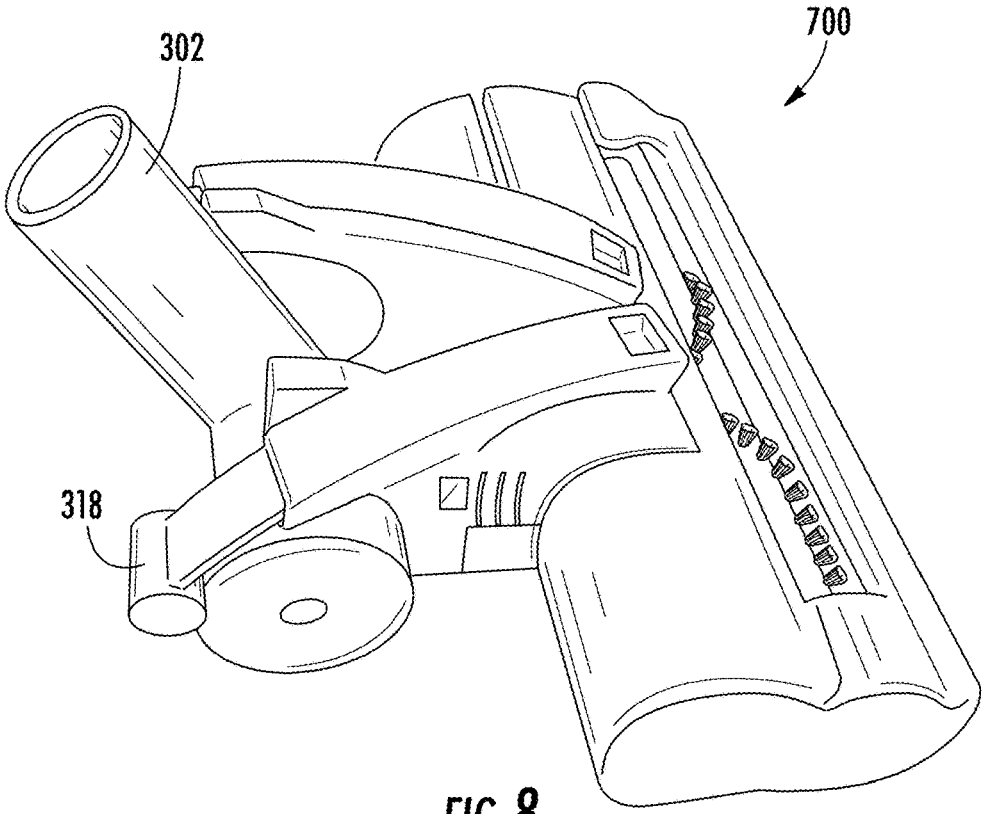
FIG. 8 shows a perspective view of the surface cleaning head of FIG. 7, consistent with embodiments of the present disclosure.
Figure 9:
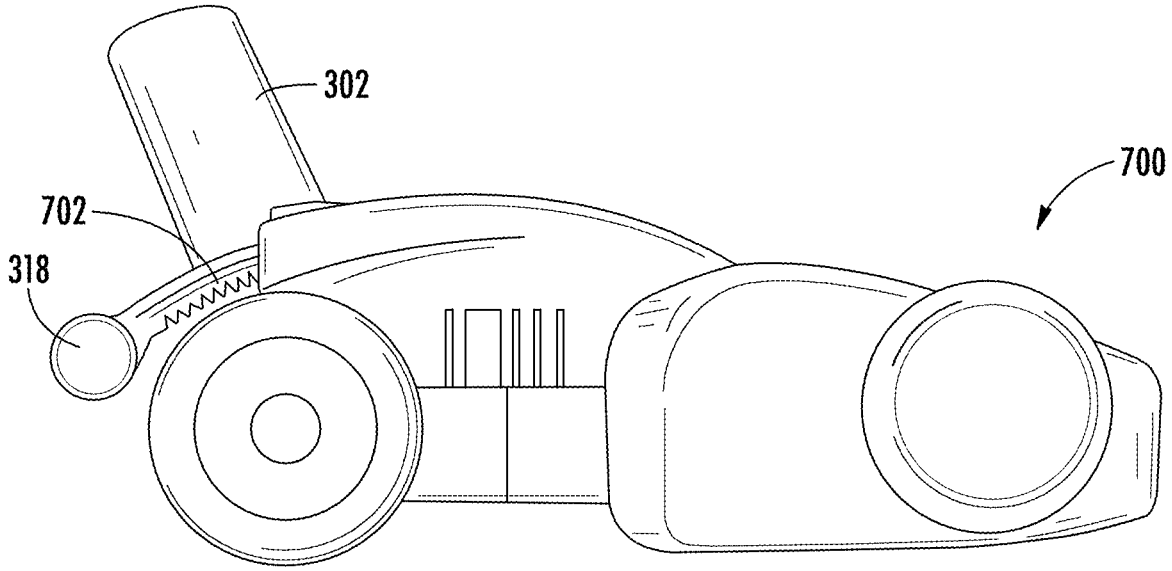
FIG. 9 shows a side view of the surface cleaning head of FIG. 7, consistent with embodiments of the present disclosure.

FIGS. 7-9 show multiple views of a surface cleaning head 700, which may be an example of the surface cleaning head 300 of FIG. 3. As shown, the stabilizer 318 can include a plurality of teeth 702 configured to engage a corresponding gear such that a rack and pinion is formed. For example, the plurality of teeth 702 can be configured to engage a gear that rotates in response to the neck 302 transitioning between a storage and an in-use position.

Figure 10:
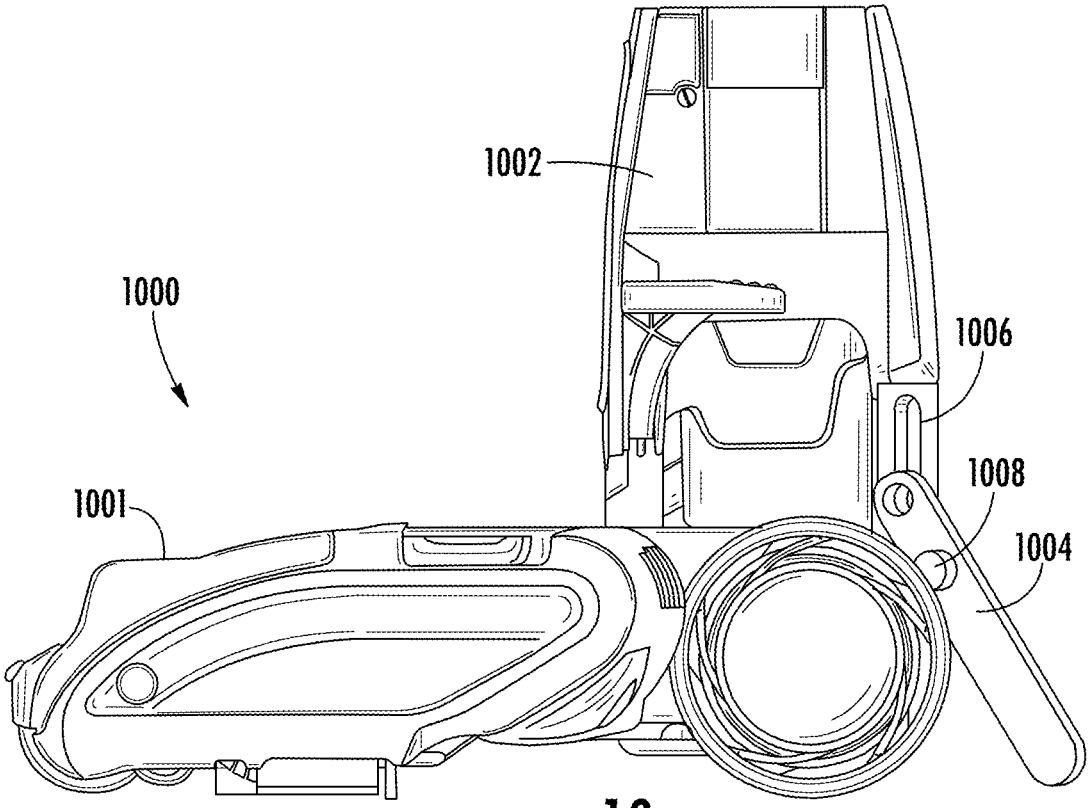
FIG. 10 shows a side view of a surface cleaning head having a neck in a storage position, consistent with embodiments of the present disclosure.
Figure 11:
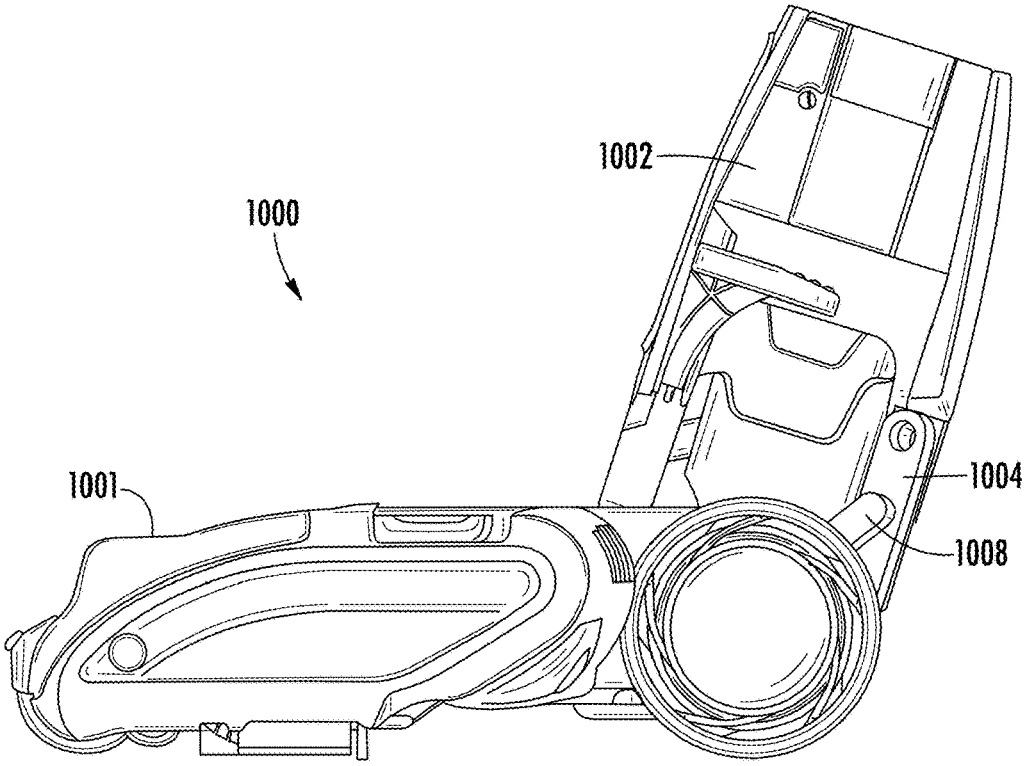
FIG. 11 shows a side view of the surface cleaning head of FIG. 10 having the neck in an in-use position, consistent with embodiments of the present disclosure.

FIG. 10 shows an example of a surface cleaning head 1000, which may be an example of the surface cleaning head 102 of FIG. 1. As shown, the surface cleaning head 1000 includes a neck 1002 pivotally coupled to a main body 1001 of the surface cleaning head 1000. The neck 1002 can be configured to pivot relative to the main body 1001 of the surface cleaning head 1000 about one or more axes. For example, the neck 1002 can be configured to pivot between an upright position (e.g., as shown in FIG. 10) and an in-use position (e.g., as shown in FIG. 11). In some instances, the neck 1002 can also be configured to pivot side-to-side.

As shown, the neck 1002 includes one or more stabilizers 1004 configured to transition between an extended position (e.g., as shown in FIG. 10) and a retracted position (e.g., as shown in FIG. 11). As the neck 1002 is transitioned from the storage position towards the in-use position, at least a portion of the stabilizer 1004 is configured to move towards the main body 1001 of the surface cleaning head 1000. As the stabilizer 1004 moves towards the main body 1001 of the surface cleaning head 1000, a portion of the stabilizer 1004 slides within a slot 1006 formed within the neck 1002, wherein the slot 1006 extends longitudinally along the neck 1002. As such, when transitioning to the retracted position, at least a portion of the stabilizer 1004 moves in a direction of the main body 1001 and at least a portion of the stabilizer moves away from the main body 1001 such that the stabilizer 1004 comes out of engagement with a surface to be cleaned (e.g., a floor).

A pivot arm 1008 can also be provided to constrain the extension distance of the stabilizer 1004. The pivot arm 1008 can be pivotally coupled to the stabilizer 1004 and to the neck 1002 or the main body 1001 of the surface cleaning head 1000. As such, as the stabilizer 1004 slides along the slot 1006, the pivot arm 1008 pivots relative to the stabilizer 1004 and the neck 1002 or the main body 1001.

In some instances, the stabilizer 1004 can be configured to extend or retract for only a portion of the pivotal movement of the neck 1002. For example, the stabilizer 1004 can begin to extend when the neck 1002 is being transitioned towards the storage position and when the neck 1002 is within a predetermined number of degrees (e.g., 2°, 5°, 7°, 10°, 15°, and/or any other suitable number of degrees) of the storage position. In other words, the stabilizer 1004 can be configured to transition between extended and retracted positions in response to the neck 1002 pivoting within a predetermined range.

Figure 12:
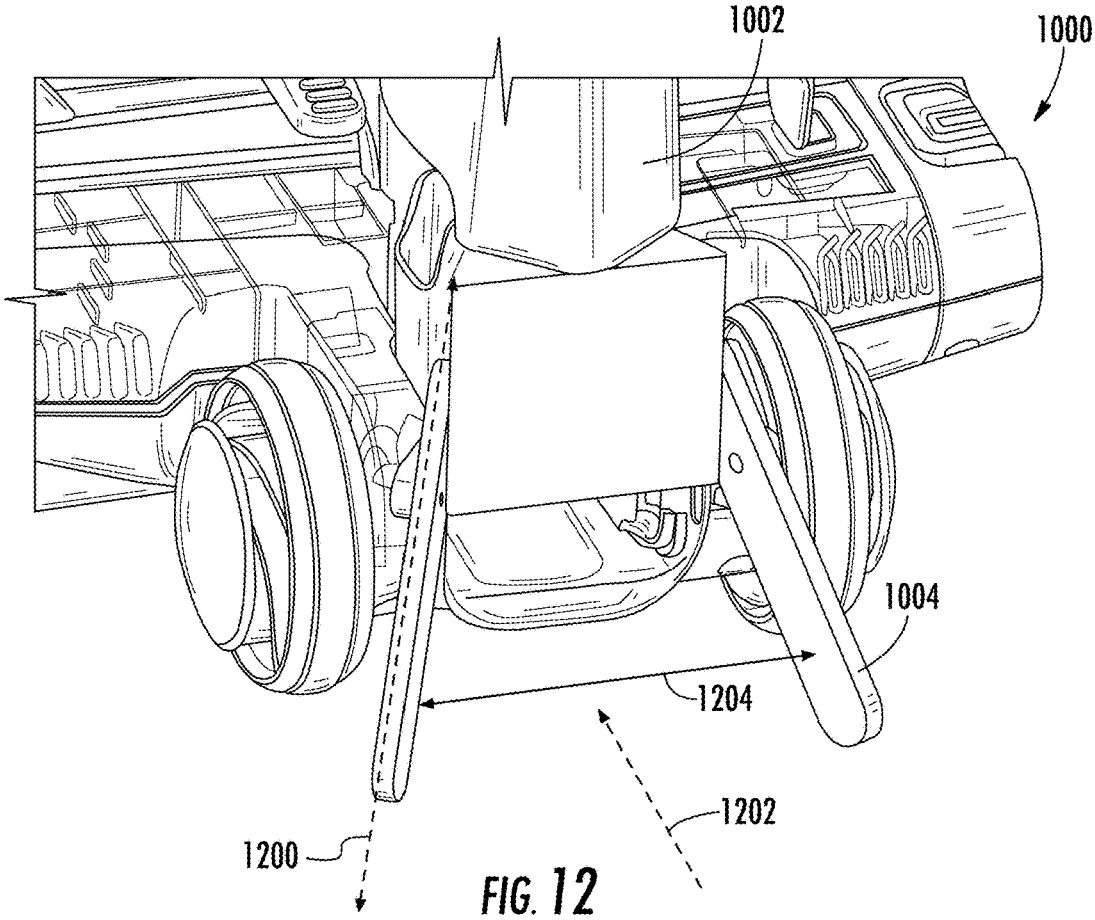
FIG. 12 shows a perspective view of the surface cleaning head of FIG. 10 having the neck in the storage position, consistent with embodiments of the present disclosure.

FIG. 12 is a perspective view of the surface cleaning head 1000 of FIG. 10. As shown, the neck 1002 can include a plurality of stabilizers 1004 configured to extend therefrom. As shown, a longitudinal axis 1200 of each of the stabilizers 1004 can extend transverse to a forward direction of travel 1202. In other words, the longitudinal axes 1200 can extend transverse to each other. As such, a separation distance 1204 extending between the stabilizers 1004 can increase as the stabilizers 1004 extend in a direction away from the main body 1001 of the surface cleaning head 1000. Such a configuration may increase the stability of the surface cleaning head 1000. In other instances, the longitudinal axes 1200 can extend parallel to each other.

Figure 13:
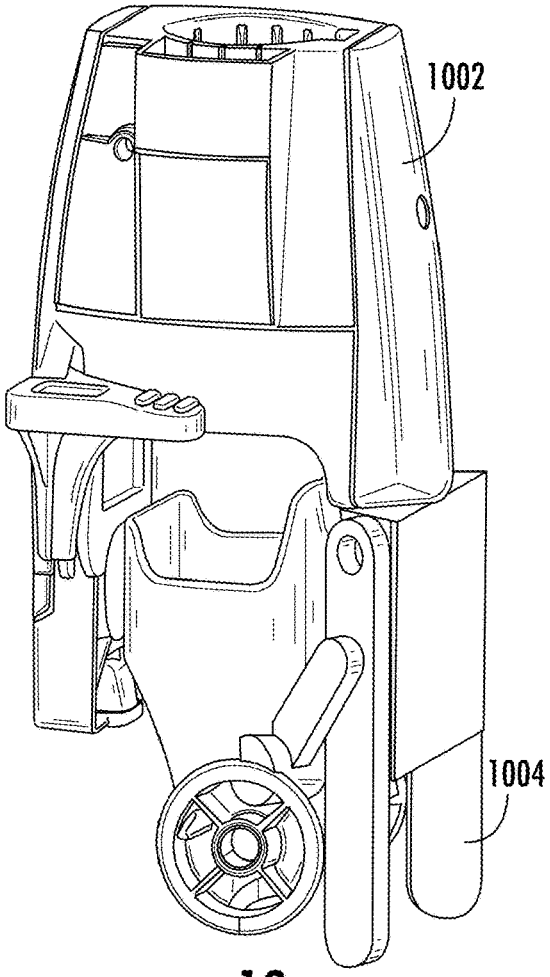
FIG. 13 shows a perspective view of the neck of FIG. 10, consistent with embodiments of the present disclosure.
Figure 14:
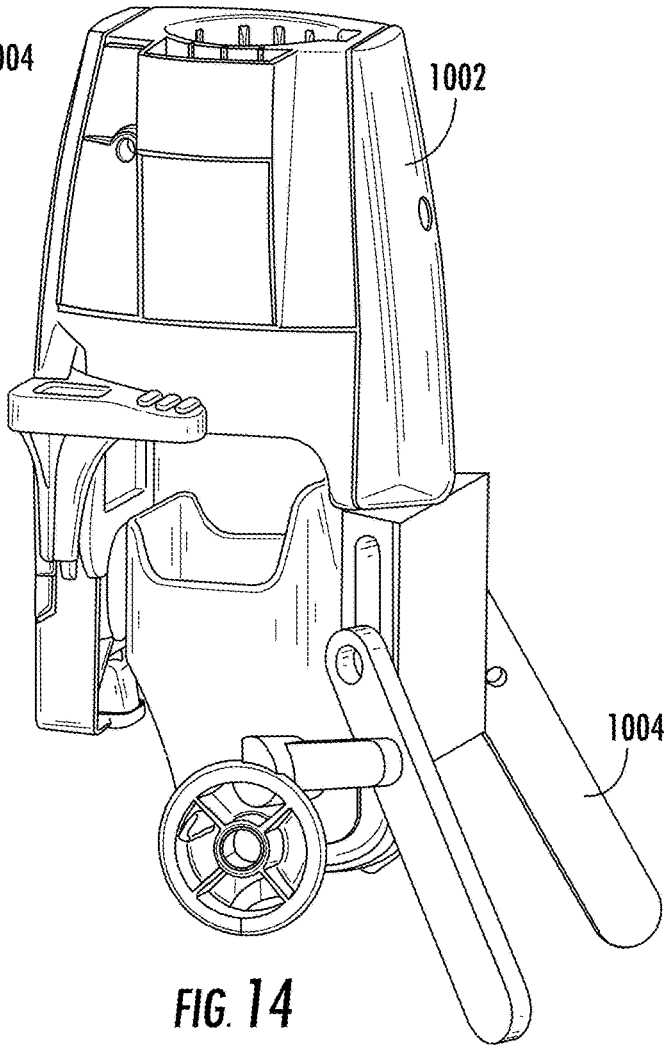
FIG. 14 shows another perspective view of the neck of FIG. 10, consistent with embodiments of the present disclosure.
Figure 15:
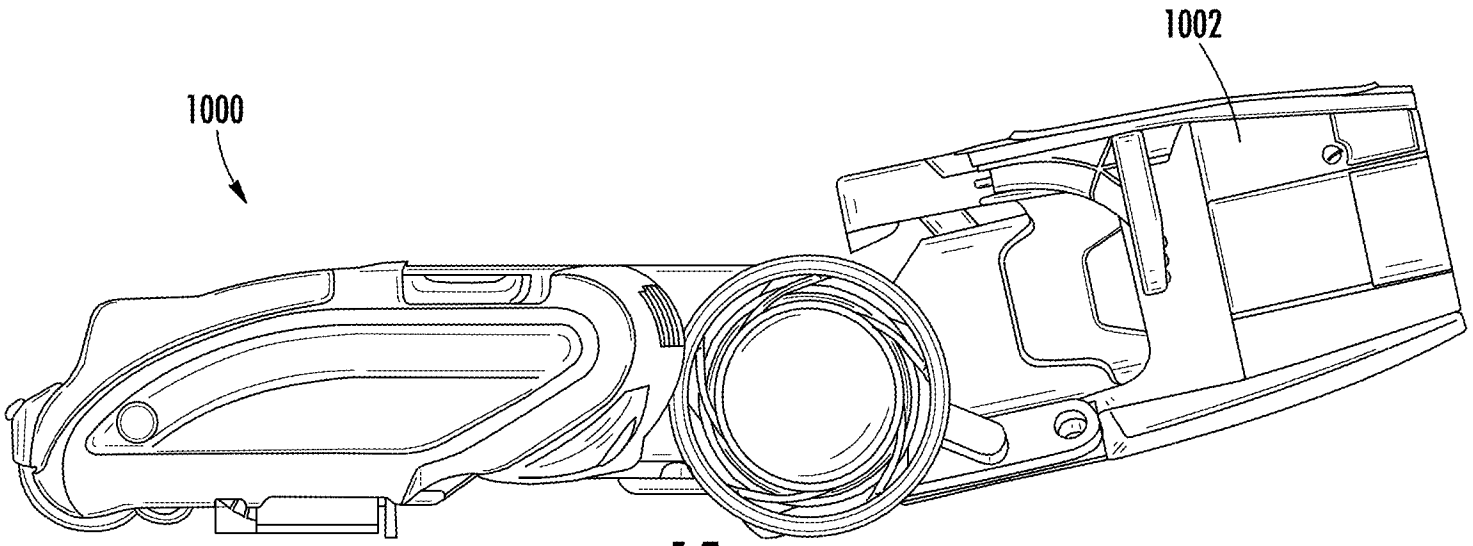
FIG. 15 shows a side view of the surface cleaning head of FIG. 10, wherein the neck is in an in-use position, consistent with embodiments of the present disclosure.

FIG. 13 shows a perspective view of the neck 1002 of FIG. 10 having the stabilizers 1004 in the retracted position and FIG. 14 shows a perspective view of the neck 1002 having the stabilizers 1004 in the extended position. FIG. 15 shows a side view of the surface cleaning head 1000 having the neck 1002 in an in-use position.

Figure 16:
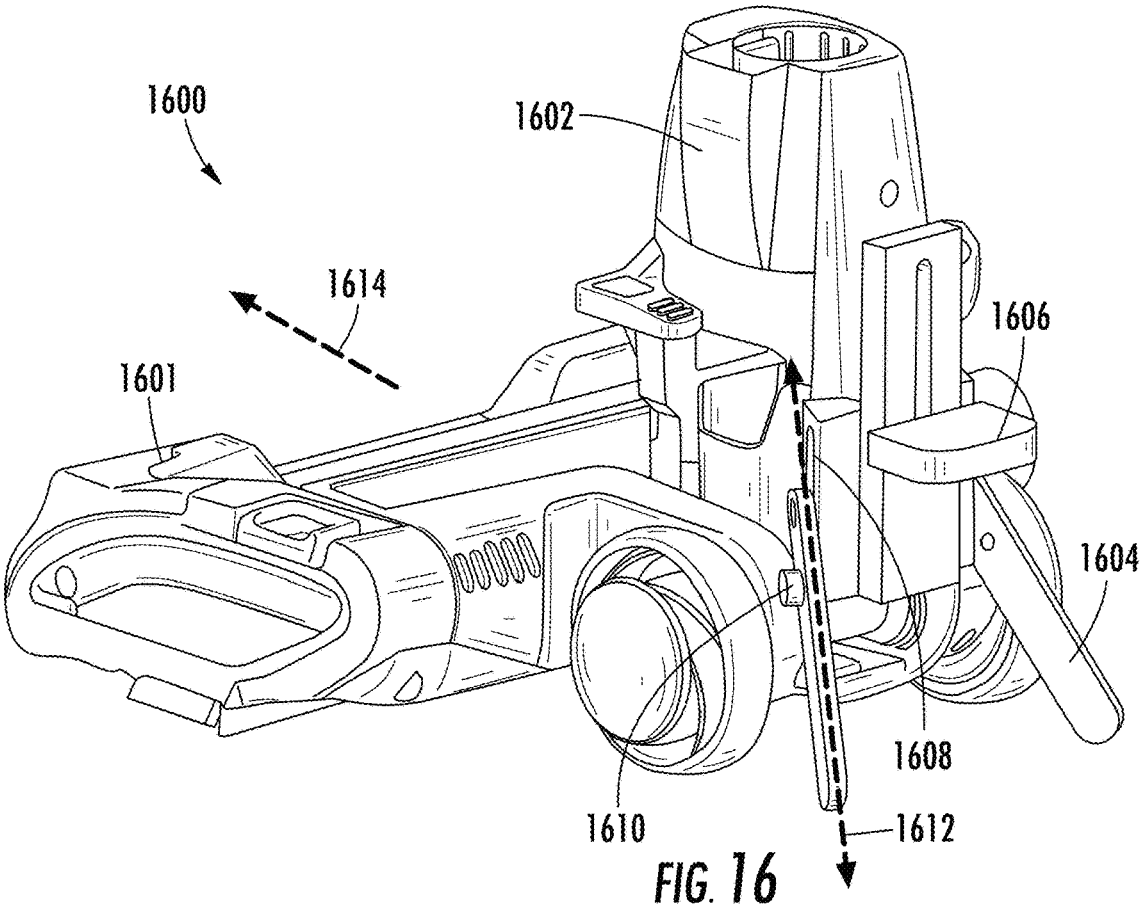
FIG. 16 shows a perspective view of a surface cleaning head, consistent with embodiments of the present disclosure.

FIG. 16 shows a perspective view of a surface cleaning head 1600, which may be an example of the surface cleaning head 102 of FIG. 1. As shown, the surface cleaning head 1600 includes a neck 1602 pivotally coupled to a main body 1601 of the surface cleaning head 1600. The neck 1602 is configured to pivot between a storage and an in-use position. In some instances, the neck 1602 can also be configured to pivot side-to-side.

Figure 17:
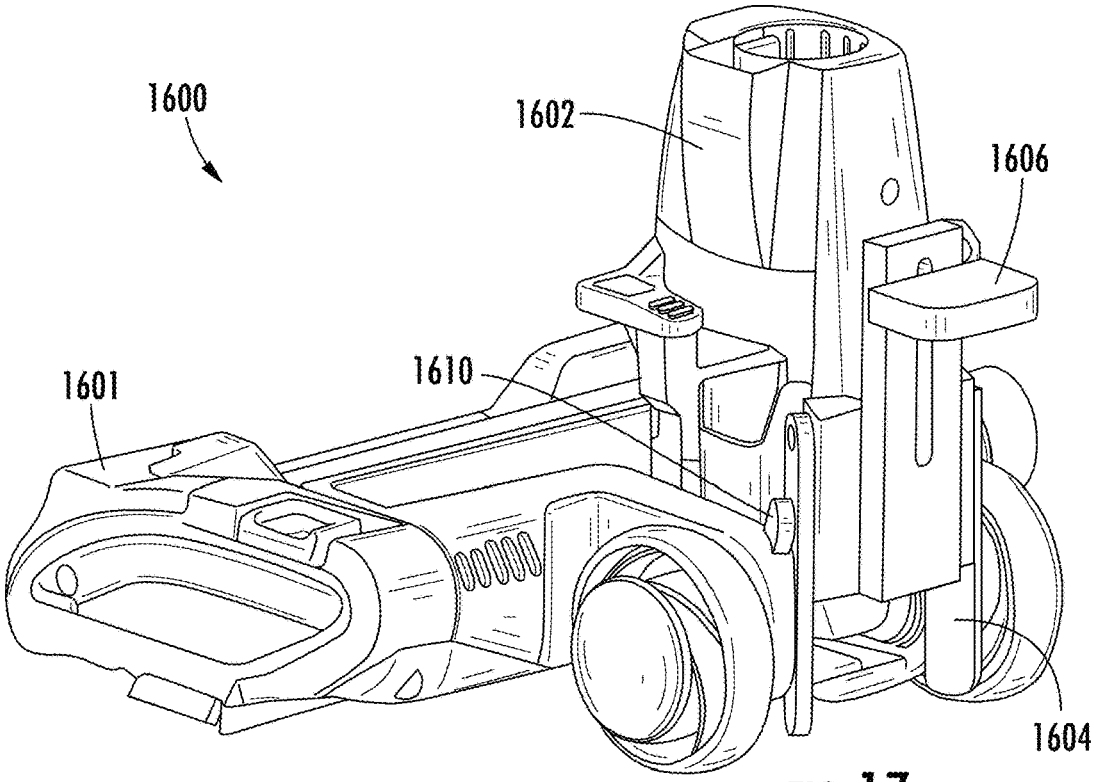
FIG. 17 shows another perspective view of the surface cleaning head of FIG. 16, consistent with embodiments of the present disclosure.

One or more stabilizers 1604 are coupled to the neck 1602 and configured to transition between an extended position (e.g., as shown in FIG. 16) and a retracted position (e.g., as shown in FIG. 17). For example, the stabilizers 1604 can be configured to transition from the retracted position to the extended position in response to actuation of a lever 1606. The lever 1606 can be configured to be actuated by a user (e.g., in response to a user depressing the lever 1606 using a foot). By way of further example, the one or more stabilizers 1604 can be configured to transition from the extended position to the retracted position in response to a subsequent actuation of the lever 1606. For example, the stabilizers 1604 can be configured such that a subsequent actuation of the lever 1606 causes a biasing mechanism (e.g., a spring) to urge the stabilizers 1604 towards the retracted position. By allowing a user to determine when to extend the one or more stabilizers 1604, it may allow the user to more easily maneuver the vacuum cleaner when, for example, the neck 1602 is in the storage position. Additionally, or alternatively, the stabilizers 1604 can be configured to transition from the extended position to the retracted position in response to transitioning the neck 1602 from a storage position towards an in-use position.

As also shown, when transitioning between the extended and retracted position, the stabilizer 1604 slides within a slot 1608 formed within the neck 1602. A pivot arm 1610 may also be pivotally coupled to the stabilizer 1604 and the neck 1602 or the main body 1601 of the surface cleaning head 1600. The pivot arm 1610 limits the distance that the stabilizer 1604 can extend from the main body 1601 of the surface cleaning head 1600.

In some instances, and as shown, a plurality of stabilizers 1604 can be coupled to the neck 1602. A longitudinal axis 1612 of each stabilizer 1604 can extend transverse to a forward movement direction 1614 of the surface cleaning head 1600. In other words, the longitudinal axes 1612 can extend transverse to each other. In other instances, the longitudinal axes 1612 can extend parallel to each other.

In some instances, the stabilizers 1604 and lever 1606 may be part of a stabilizer assembly that is removably coupled to the neck 1602. As such, the stabilizer assembly can be installed by a user of the vacuum cleaner.

Figure 18:
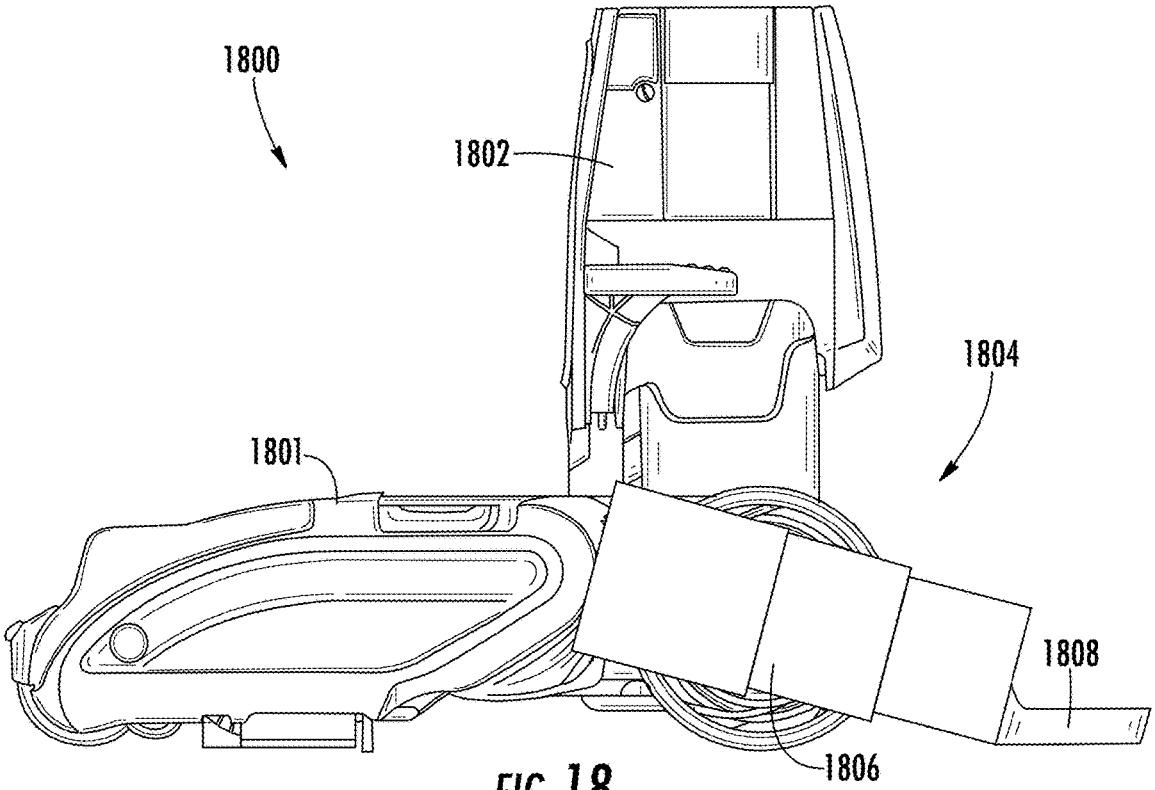
FIG. 18 shows a side view of a surface cleaning head in a storage position, consistent with embodiments of the present disclosure.

FIG. 18 shows a perspective view of a surface cleaning head 1800, which may be an example of the surface cleaning head 102 of FIG. 1. As shown, the surface cleaning head 1800 includes a neck 1802 pivotally coupled to a main body 1801 of the surface cleaning head 1800. The neck 1802 can be configured to pivot side-to-side and between a storage position (e.g., as shown in FIG. 18) and an in-use position (e.g., as shown in FIG. 19).

As shown in FIG. 18, when the neck 1802 is in the storage position, a stabilizer 1804 is configured to extend from the main body 1801 of the surface cleaning head 1800. The stabilizer 1804 can be configured such that it transitions to an extended position (e.g., as shown in FIG. 18) when the neck 1802 transitions to the storage position. For example, the stabilizer 1804 can include a biasing mechanism that urges the stabilizer 1804 towards the extended position. As such, when the neck 1802 transitions to the storage position, the neck 1802 may cause a latch to be released such that the stabilizer 1804 extends.

As also shown, the stabilizer 1804 includes a plurality of telescoping parts 1806, wherein at least one of the telescoping parts 1806 is configured to receive at least one other telescoping part 1806. A distal most telescoping part 1806 can include a support 1808 extending therefrom. The support 1808 can extend from the distal most telescoping part 1806 at an angle such that the support 1808 extends substantially parallel to a surface on which the surface cleaning head 1800 rests (e.g., a floor).

Figure 19:
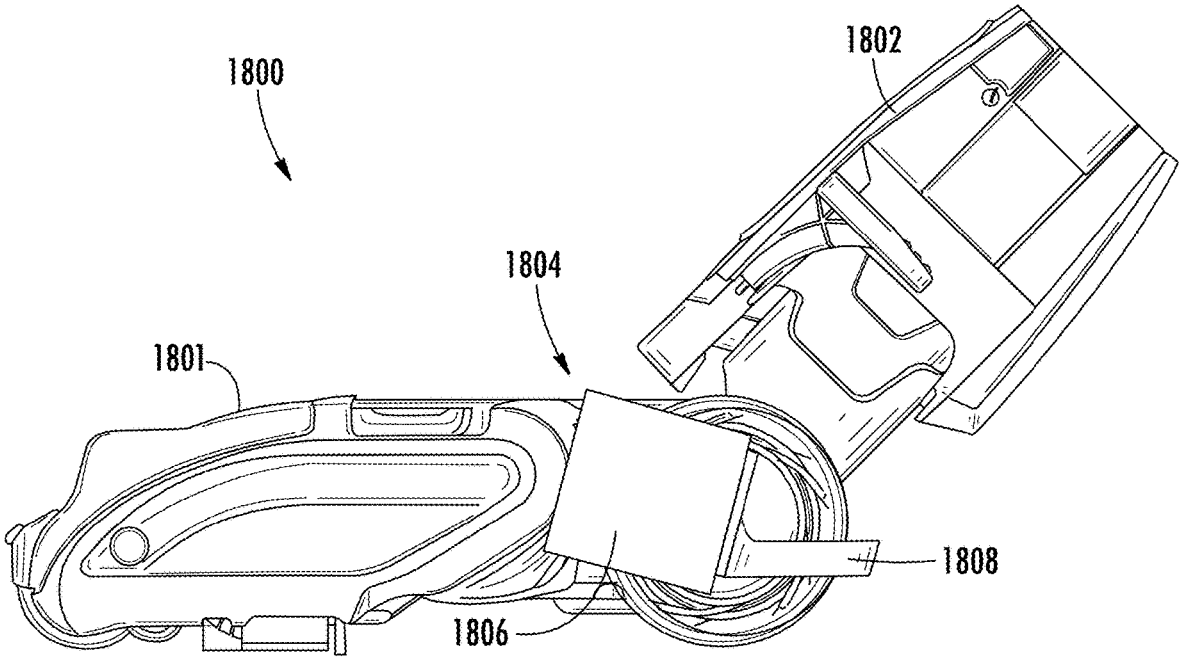
FIG. 19 shows a side view of the surface cleaning head of FIG. 18 in an in-use position, consistent with embodiments of the present disclosure.

The stabilizer 1804 may transition from the extended position to a retracted position (e.g., as shown in FIG. 19) in response to a user exerting a force on the telescoping parts 1806 such that one or more of the telescoping parts 1806 are received within at least one other telescoping part 1806. In some instances, the stabilizer 1804 may be transitioned from the extended position to the retracted position in response to the neck 1802 being transitioned from the in-use position to the storage position.

Figure 20:
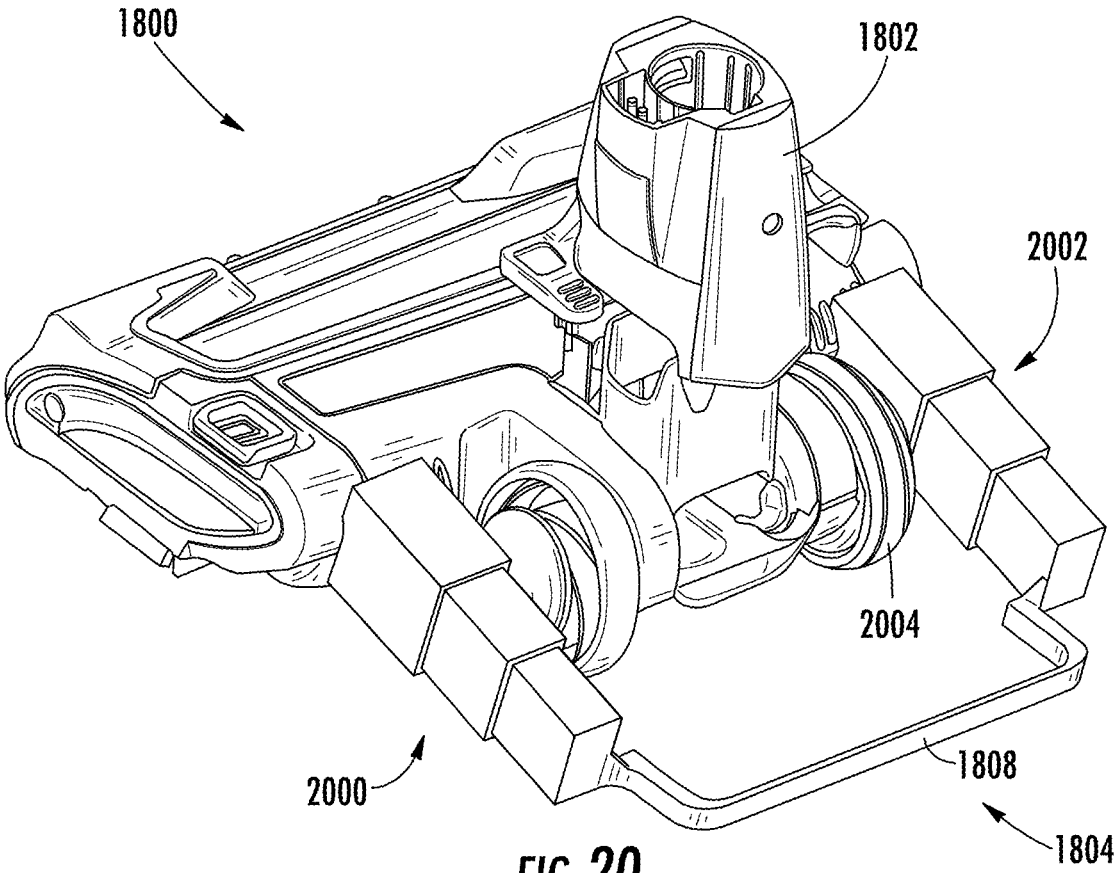
FIG. 20 shows a perspective view of the surface cleaning head of FIG. 18, consistent with embodiments of the present disclosure.
Figure 21:
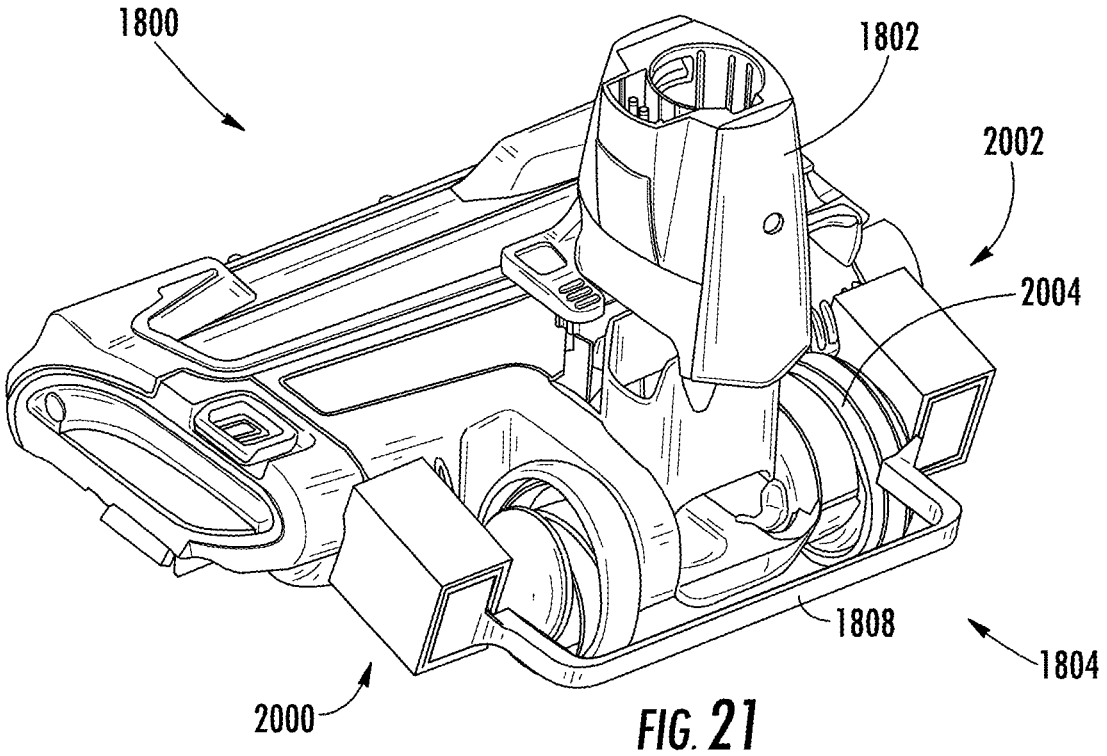
FIG. 21 shows another perspective view of the surface cleaning head of FIG. 18, consistent with embodiments of the present disclosure.

FIG. 20 shows a perspective view of the stabilizer 1804 in the extended position and FIG. 21 shows a perspective view of the stabilizer 1804 in the retracted position. As shown, the stabilizer 1804 can include a first plurality of telescoping parts 2000 and a second plurality of telescoping parts 2002. The first and second plurality of telescoping parts 2000 and 2002 are disposed on opposing sides of the surface cleaning head 1800. For example, the neck 1802 and one or more wheels 2004 can be disposed between at least a portion of the first and second plurality of telescoping parts 2000 and 2002.

As shown, the support 1808 can extend between the first and second plurality of telescoping parts 2000 and 2002. To transition the stabilizer 1804 from the extended position to the retracted position, a user may exert a force on the support 1808 (e.g., using a foot). For example, a user may, while causing the neck 1802 to be transitioned into an in-use position, transition the stabilizer 1804 into the retracted position.

Figure 22:
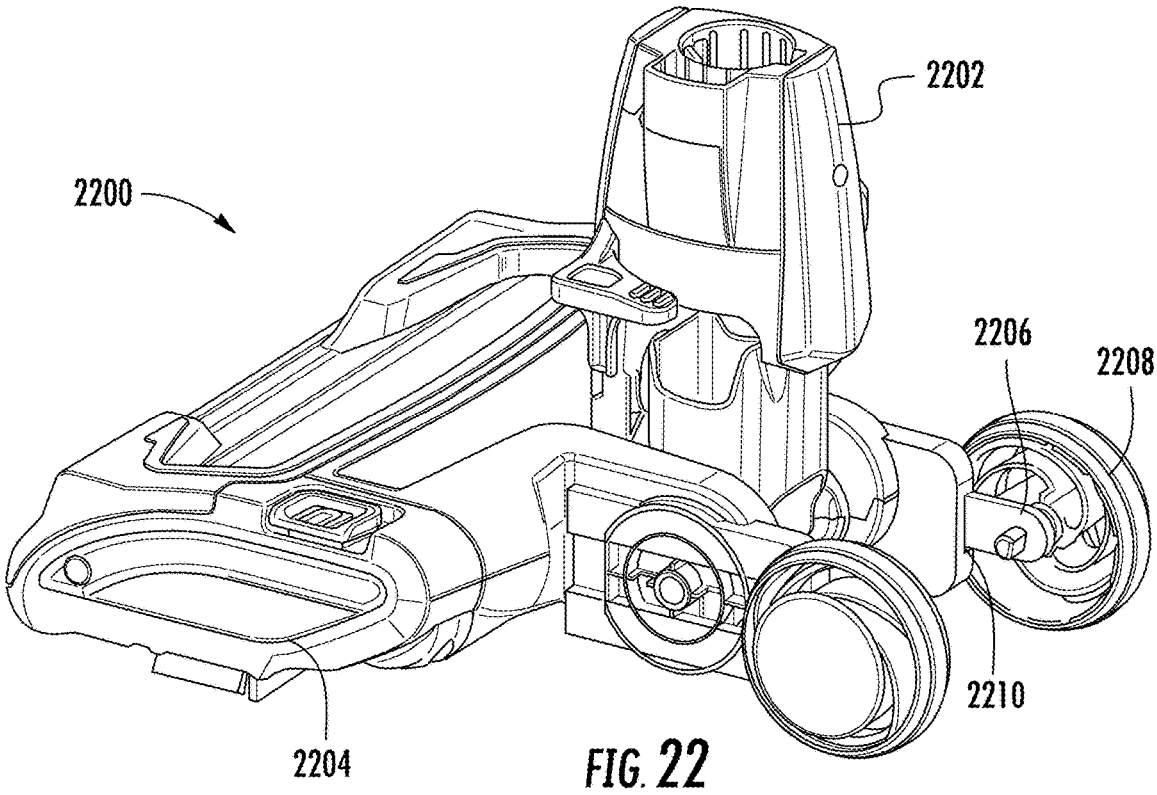
FIG. 22 shows a perspective view of a surface cleaning head in a storage position, consistent with embodiments of the present disclosure.

FIG. 22 shows a perspective view of a surface cleaning head 2200, which may be an example of the surface cleaning head 102 of FIG. 1. As shown, the surface cleaning head 2200 includes a neck 2202 pivotally coupled to a main body 2204 of the surface cleaning head 2200. The neck 2202 can be configured to pivot side-to-side and between a storage position (e.g., as shown in FIG. 22) and an in-use position (e.g., as shown in FIG. 23).

Figure 23:
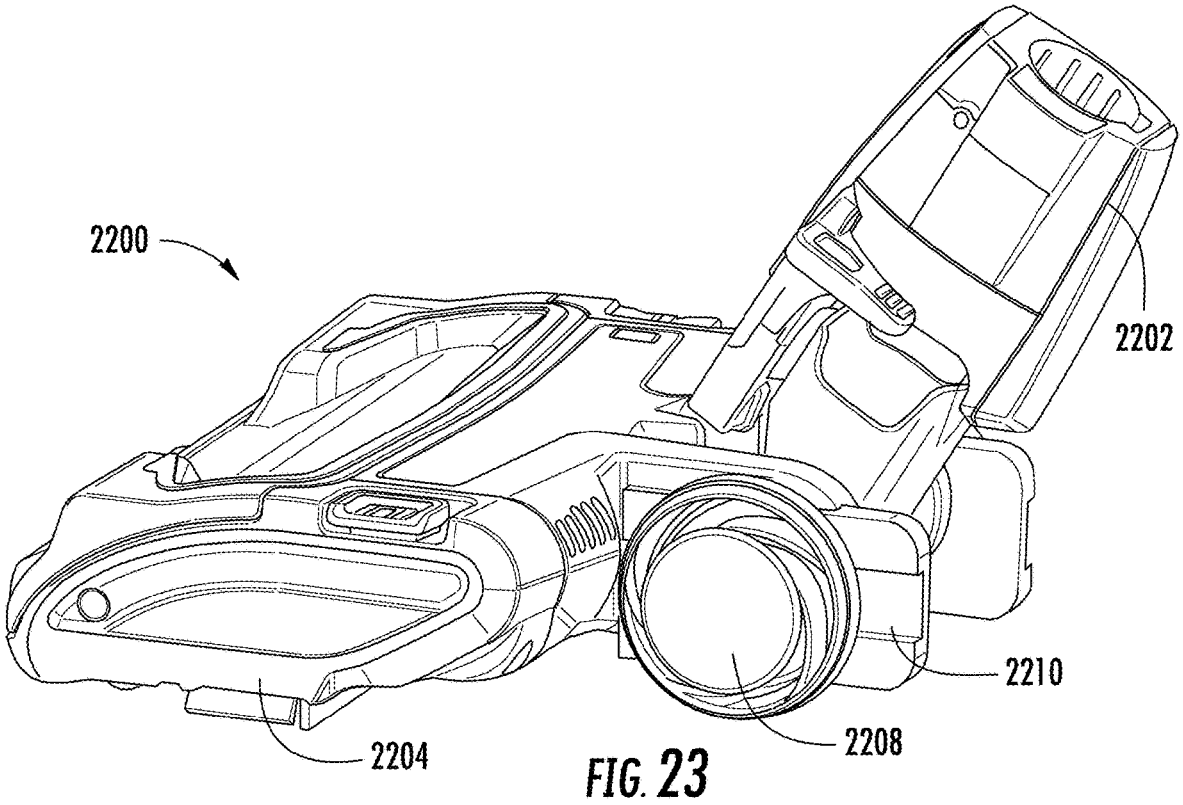
FIG. 23 shows a perspective view of the surface cleaning head of FIG. 22 in an in-use position, consistent with embodiments of the present disclosure.

As shown, the surface cleaning head 2200 can include a stabilizer 2206 configured to transition between an extended position (e.g., as shown in FIG. 22) and a retracted position (e.g., as shown in FIG. 23). The stabilizer 2206 can transition between the extended and retracted positions in response to, for example, the transitioning of the neck 2202 between the storage and in-use positions.

In some instances, the stabilizer 2206 can be configured to extend or retract for only a portion of the pivotal movement of the neck 2202. For example, the stabilizer 2206 can begin to extend when the neck 2202 is being transitioned towards the storage position and when the neck 2202 is within a predetermined number of degrees (e.g., 2°, 5°, 7°, 10°, 15°, and/or any other suitable number of degrees) of the storage position. In other words, the stabilizer 2206 can be configured to transition between extended and retracted positions in response to the neck 2202 pivoting within a predetermined range.

Figure 24:
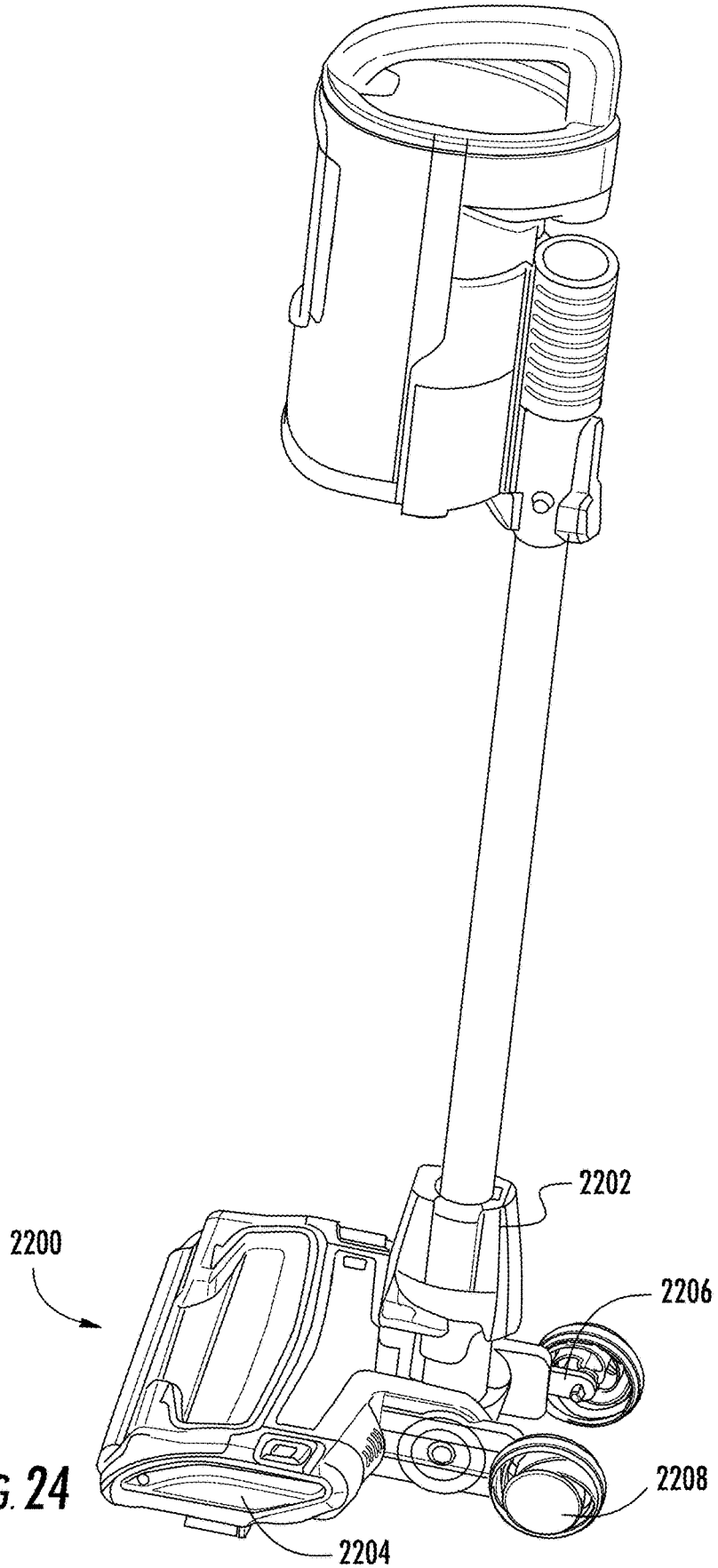
FIG. 24 shows a perspective view of the surface cleaning head of FIG. 22 coupled to a suction device, consistent with embodiments of the present disclosure.

The stabilizer 2206 can be coupled to one or more wheels 2208. As such, when the stabilizer 2206 transitions between the extended and retracted positions, the stabilizer 2206 urges the one or more wheels 2208 between an extended position (e.g., as shown in FIG. 22) and a retracted position (e.g., as shown in FIG. 23). When in the retracted position, the one or more wheels 2208 can be used to maneuver the surface cleaning head 2200 over a surface (e.g., a floor) during a cleaning operation. When in the extended position, the one or more wheels 2208 may improve the stability of the surface cleaning head 2200 when the neck 2202 is in the storage position while still allowing the surface cleaning head 2200 to be maneuvered over the surface using the one or more wheels 2208 (e.g., as shown in FIG. 24).

As shown, the stabilizer 2206 can be configured to slideably engage a track 2210 defined in at least a portion of the main body 2204 of the surface cleaning head 2200. Additionally, or alternatively, the track 2210 can be defined in at least a portion of the neck 2202. In some instances, and as shown, the track 2210 can be configured to extend beyond a rearward most portion of the one or more wheels 2208 when the one or more wheels 2208 are in the retracted position. In other words, when in the retracted position, the one or more wheels 2208 can be disposed between the main body 2204 of the surface cleaning head 2200 and a distal most portion of the track 2210. In other instances, the track 2210 may be defined within the main body 2204 such that the track does not extend beyond the one or more wheels 2208 when the one or more wheels 2208 are in the retracted position.

Figure 25:
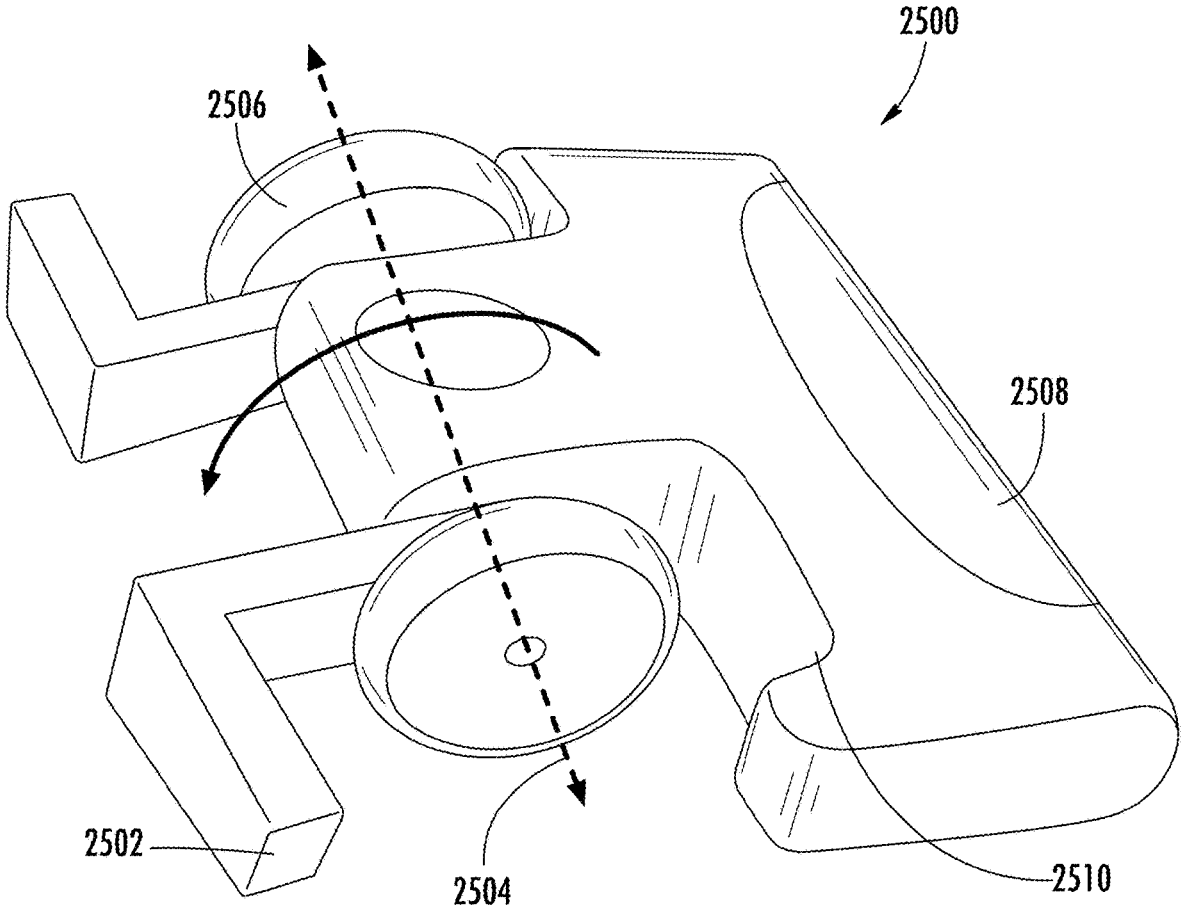
FIG. 25 shows a schematic view of a surface cleaning head, consistent with embodiments of the present disclosure.

FIG. 25 shows a schematic view of a surface cleaning head 2500, which may be an example of the surface cleaning head 102 of FIG. 1. As shown, the surface cleaning head 2500 includes a plurality of stabilizers 2502 configured to rotate about a rotation axis 2504. In some instances, the rotation axis 2504 may be the axis about which one or more wheels 2506 rotatably coupled to a main body 2508 of the surface cleaning head 2500 rotate. When in the extended position (e.g., as shown in FIG. 25) the one or more wheels 2506 are disposed between at least a portion of the stabilizers 2502 and the main body 2508 of the surface cleaning head 2500. When in the retracted position, the stabilizers 2502 are received within a corresponding receptacle 2510 defined within the main body 2508 of the surface cleaning head 2500.

While the stabilizers 2502 are shown as having an "L" shape, other configurations are possible. For example, the stabilizers 2502 may have a "J" shape, a "P" shape, a "T" shape, and/or any other suitable shape. In some instances, the stabilizers 2502 may be substantially straight and may not include a portion that is configured to extend behind the one or more wheels 2506.

In some instances, the stabilizers 2502 may be coupled together such that the stabilizers 2502 collectively form a "U" shaped stabilizer. In these instances, the "U" shaped stabilizer maybe configured such that is extends between the wheels 2506 or such that the wheels 2506 are disposed within the area defined within the "U" shaped stabilizer.

Figure 26:
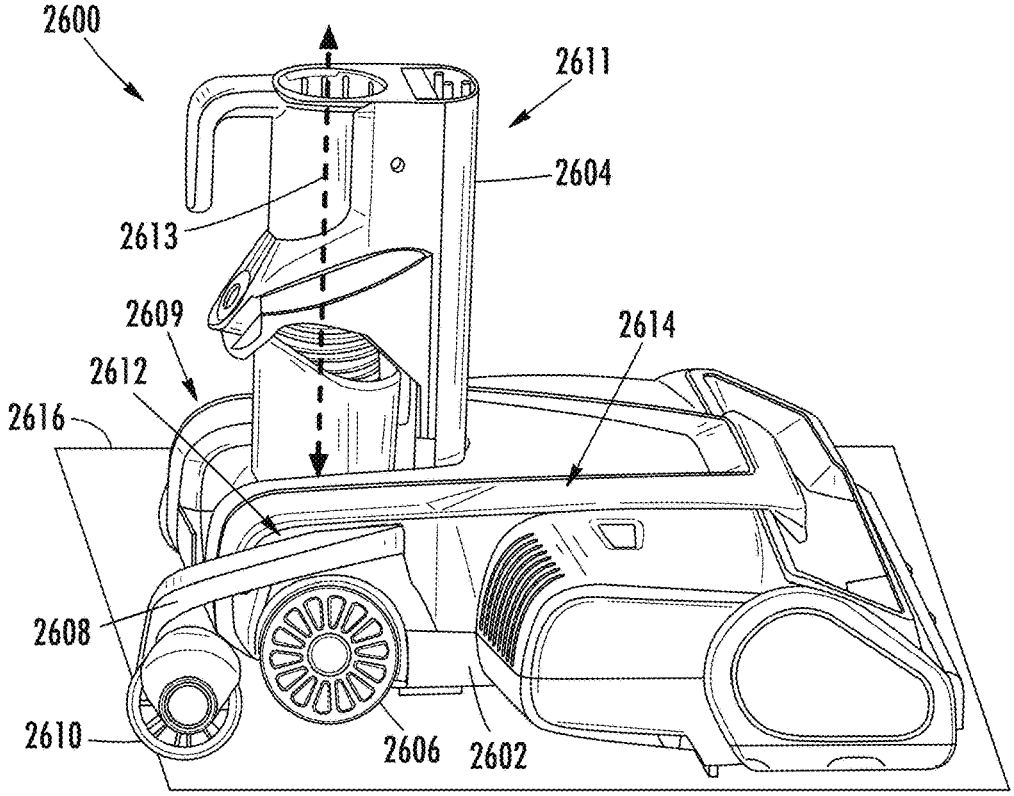
FIG. 26 shows a perspective view of a surface cleaning head having a plurality of stabilizers in an extended position, consistent with embodiments of the present disclosure.
Figure 27:
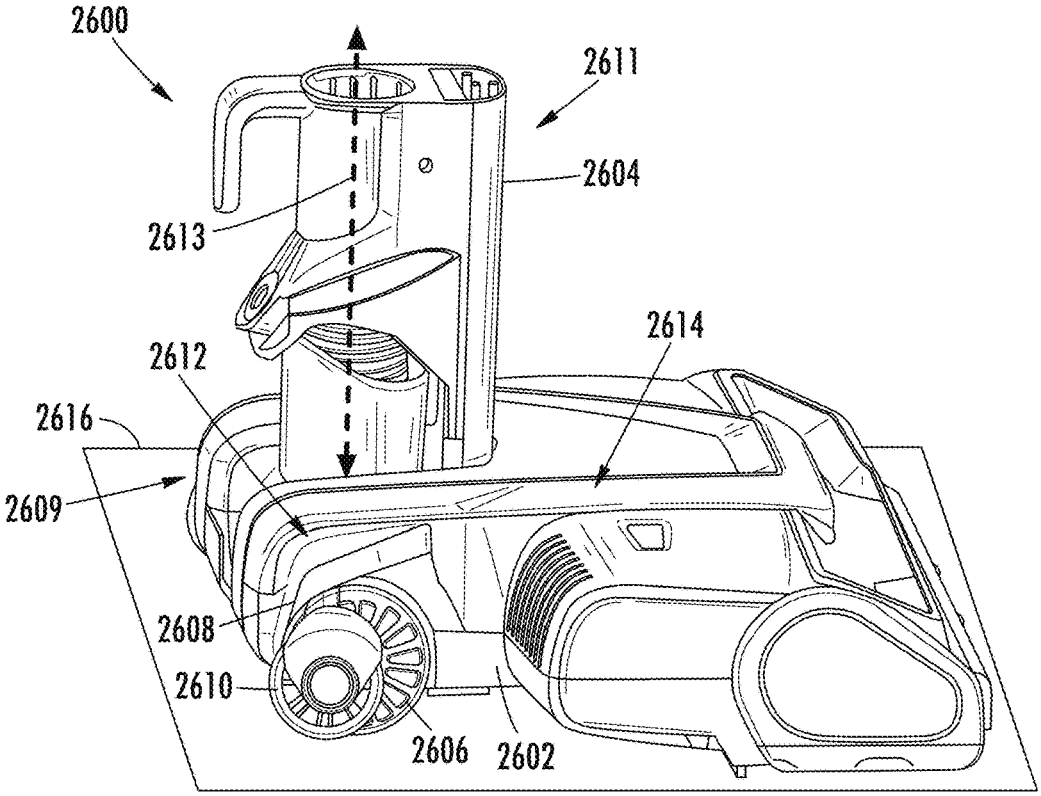
FIG. 27 shows a perspective view of the surface cleaning head of FIG. 26 having the plurality of stabilizers in the retracted position, consistent with embodiments of the present disclosure.

FIGS. 26 and 27 show perspective side views of a surface cleaning head 2600, which may be an example of the surface cleaning head 102 of FIG. 1. As shown, the surface cleaning head 2600 includes a main body 2602, a neck 2604 that is pivotally coupled to the main body 2602 and that is configured to receive a wand (e.g., the wand 304 of FIG. 3), a plurality of main wheels 2606 (e.g., wheels used to maneuver the surface cleaning head 2600 during use while cleaning) rotatably coupled to the main body 2602, and a plurality of stabilizers 2608 configured to transition between an extended position (e.g., as shown in FIG. 26) and a retracted position (e.g., as shown in FIG. 27). The stabilizers 2608 can each include a respective stabilizer wheel 2610. When in the extended position, a substantial portion of the stabilizer wheels 2610 (e.g., at least 95% of a diameter of the stabilizer wheels 2610) can extend beyond a rearmost surface 2609 of the main body 2602 and, when in the retracted position, the stabilizer wheels 2610 can extend substantially between the rearmost surface 2609 and a forward most surface 2611 of the neck 2604 (e.g., a measure of a length of the stabilizer wheel 2610 extending beyond a respective surface measures less than 5% of a diameter of the stabilizer wheels 2610).

As shown, the stabilizers 2608 extend from a respective stabilizer opening 2612 defined in the main body 2602. Each stabilizer opening 2612 can be configured to be angled in a direction of a surface to be cleaned 2616 and may be defined in the main body 2602 at a location between a top surface 2614 of the main body 2602 and a respective main wheel 2606. As such, at least a portion of each stabilizer 2608 can extend over at least a portion of a respective main wheel 2606. In some instances, the stabilizer opening 2612 can be defined in the main body 2602 such that at least a portion is disposed on opposing sides of a central longitudinal axis 2613 of the neck 2604.

When the stabilizers 2608 transition to the extended position, the stabilizer wheels 2610 transition into engagement (e.g., contact) with the surface to be cleaned 2616. When the stabilizers 2608 transition to the retracted position, the stabilizer wheels 2610 transition out of engagement (e.g., contact) with the surface to be cleaned 2616. As such, in some instances, the stabilizers 2608 can extend from the main body 2602 at an angle and in a direction of the surface to be cleaned 2616 such that the stabilizer wheels 2610 transition into and out of engagement with the surface to be cleaned 2616.

Figure 28:
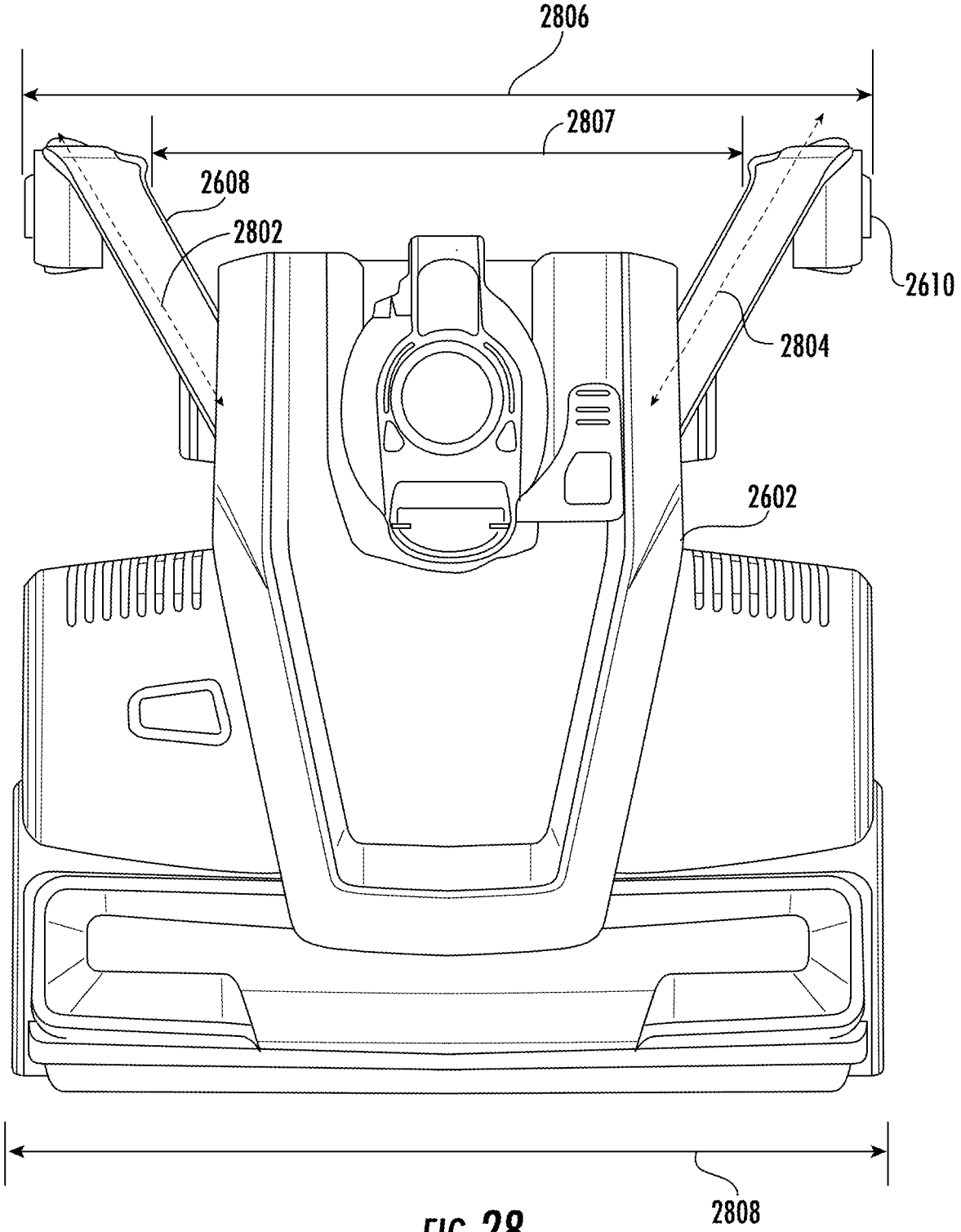
FIG. 28 shows a top view of the surface cleaning head of FIG. 26, consistent with embodiments of the present disclosure.
Figure 29:
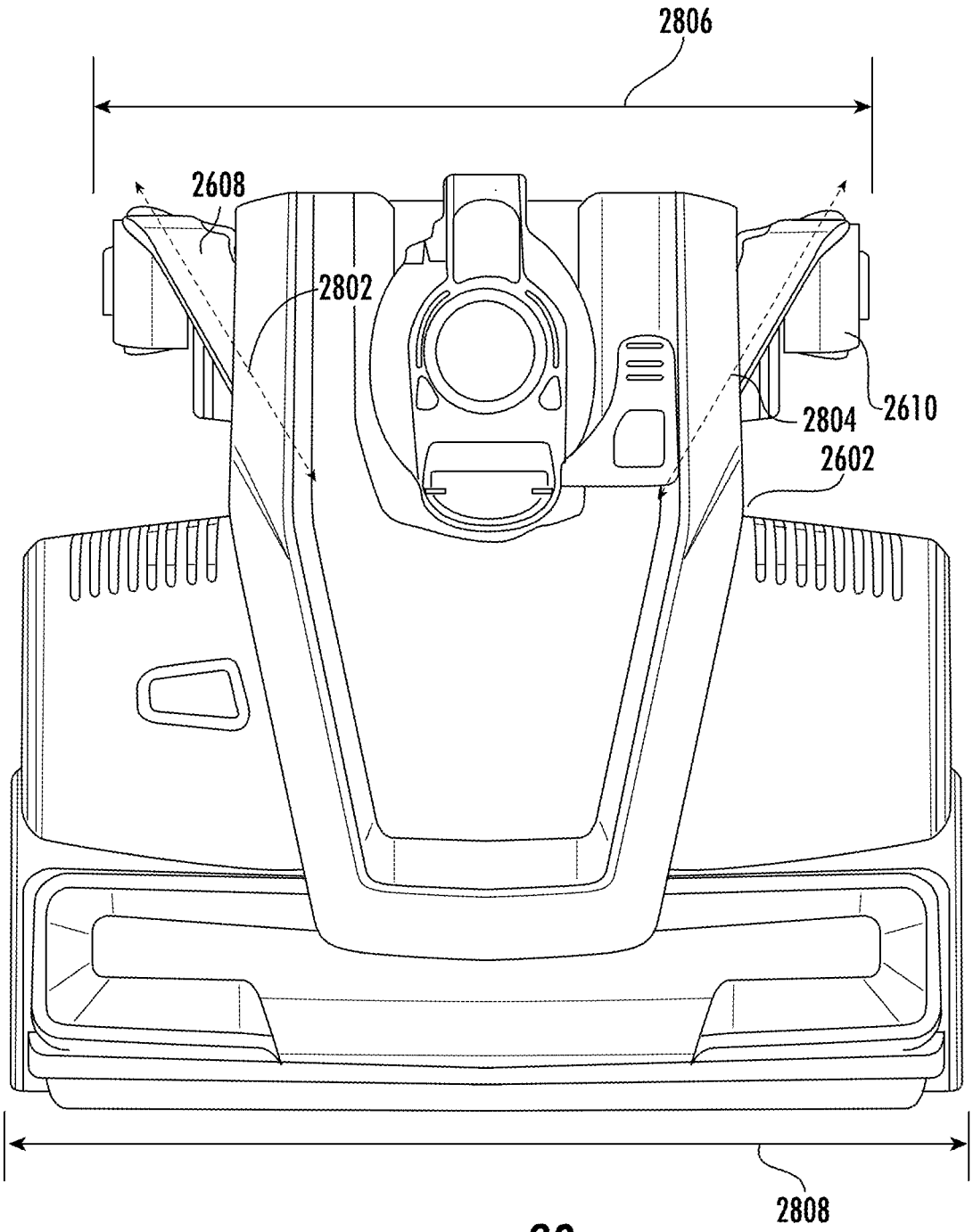
FIG. 29 shows a top view of the surface cleaning head of FIG. 27, consistent with embodiments of the present disclosure.

As shown in FIG. 28, the stabilizers 2608 extend outwardly from the main body 2602 along respective extension axes 2802 and 2804. The first extension axis 2802 extends transverse to the second extension axis 2804. As such, a stabilizer width 2806 increases with increasing distance from the main body 2602. In other words, a separation distance 2807 extending between the stabilizers 2608 increases with increasing distance from the main body 2602. As shown, the stabilizer width 2806 extends between outermost surfaces of the stabilizer wheels 2610. In some instances, for example, when the stabilizers 2608 are in the extended position, the stabilizer width 2806 may measure substantially equal to a surface cleaning head width 2808. When transitioned to the retracted position, as shown in FIG. 29, the stabilizer width 2608 may, for example, measure less than the surface cleaning head width 2808.

Figure 30:
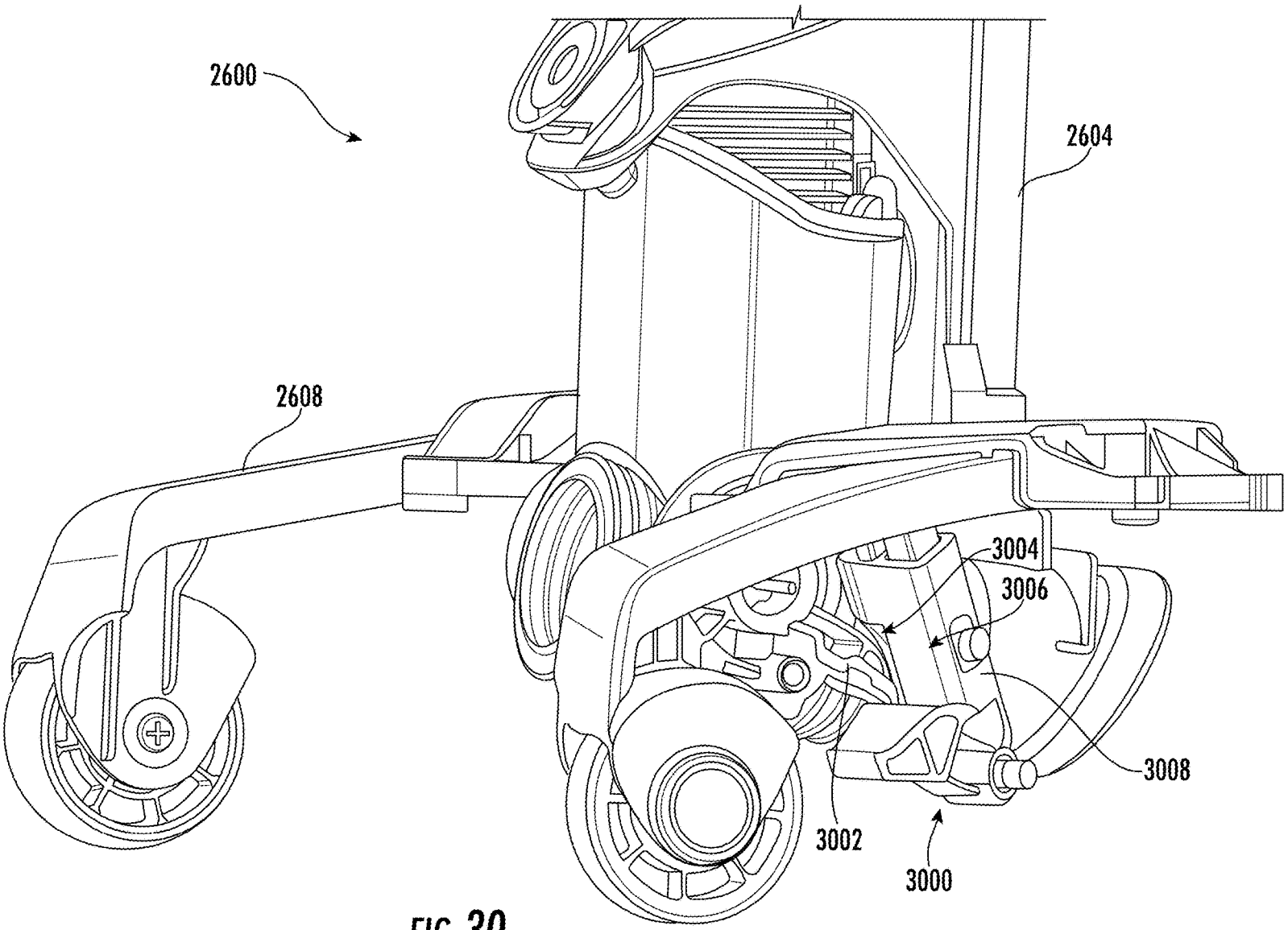
FIG. 30 shows an exploded perspective view of a portion of the surface cleaning head of FIG. 26, consistent with embodiments of the present disclosure.

FIG. 30 shows an exploded perspective view of a portion of the surface cleaning head 2600, wherein the stabilizers 2608 are in the extended position. As shown, each stabilizer 2608 is configured to be urged between the extended and retracted position in response to the neck 2604 engaging a linkage 3000. The linkage 3000 can be pivotally coupled to a portion of the main body 2602 of the surface cleaning head 2600 and the neck 2604 can include a protrusion 3002 configured to engage at least a portion of the linkage 3000. The engagement between the protrusion 3002 and the linkage 3000 causes the linkage 3000 to pivot relative to the main body 2602 in response to pivotal movement of the neck 2604.

As the linkage 3000 pivots between a first pivot position and a second pivot position, the stabilizer 2608 is caused to transition between the extended and retracted position. In other words, each linkage 3000 is configured to cause a respective stabilizer 2608 to transition between the extended and retracted positions in response to the pivotal movement of the neck 2604. As such, the linkage 3000 can be configured to resist pivotal movement when the linkage 3000 is in the first pivot position and/or the second pivot position such that the stabilizers 2608 are maintained in a respective one of the extended or retracted positions. For example, when the stabilizers 2608 are in the extended position and the linkage is in the first pivot position, the linkage 3000 may be configured to engage and/or form a portion of a mechanical locking mechanism (e.g., a detent, a snap fit, a friction fit, and/or any other mechanical locking mechanism) and, when the stabilizers 2608 are in the retracted position and the linkage 3000 is in the second pivot position, the linkage 3000 may be biased to the second pivot position by a biasing mechanism (e.g., a spring, an elastic material, such as a rubber, and/or any other biasing mechanism). Such a configuration may allow the stabilizers 2608 to be urged into the retracted position by the biasing force exerted on the linkage 3000 by the biasing mechanism. By way of further example, the linkage 3000 may be retained in the first and second pivot positions using a mechanical locking mechanism.

The protrusion 3002 can extend from the neck 2604 and engage a recess 3004 defined in the linkage 3000. The recess 3004 can be defined in an outer surface 3006 of a pivot arm 3008 of the linkage 3000. As the neck 2604 pivots between a storage and in-use position, the protrusion 3002 engages at least a portion of the recess 3004 such that at least a portion of the linkage 3000 is caused to pivot in a direction opposite that of the neck 2604.

Figure 31:
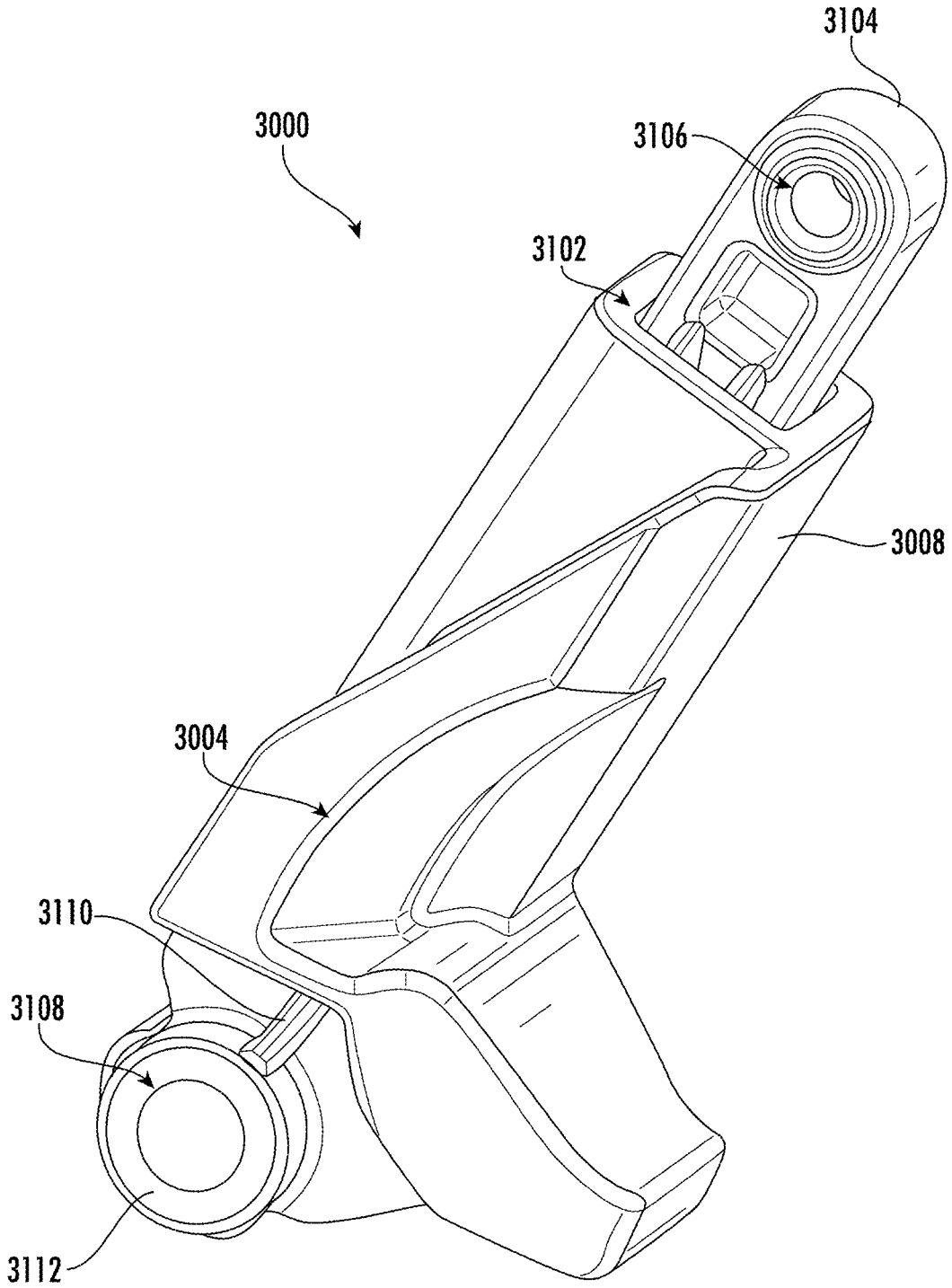
FIG. 31 shows a perspective view of a linkage of the surface cleaning head of FIG. 26, consistent with embodiments of the present disclosure.

FIG. 31 shows a perspective view of the linkage 3000 of FIG. 30. As shown, the pivot arm 3008 defines a channel 3102 configured to slideably receive a plunger 3104. As the linkage 3000 pivots in response to the neck 2604 transitioning between the storage and in-use positions, the plunger 3104 slides within the channel 3102. As also shown, the recess 3004 can have a generally arcuate shape. Additionally, or alternatively, at least a portion of the recess 3004 can be tapered.

As shown, the plunger 3104 can define a plunger opening 3106. The plunger opening 3106 can be configured to receive a shaft therethrough such that the shaft rotates relative to the plunger opening 3106. For example, the plunger 3104 can be pivotally coupled to a respective stabilizer 2608 using a shaft that extends through the stabilizer 2608 and the plunger opening 3106. As such, the linkage 3000 can generally be described as being pivotally coupled to the stabilizer 2608. In some instances, the plunger opening 3106 can include a bearing to facilitate rotation of the shaft relative to the plunger opening 3106.

As also shown, the pivot arm 3008 can include a pivot arm opening 3108. The pivot arm opening 3108 can be configured to receive a shaft therethrough such that the shaft rotates relative to the pivot arm opening 3108. For example, the pivot arm 3008 can be coupled to the main body 2602 of the surface cleaning head 2600 using a shaft that extends from the main body 2602 such that the pivot arm 3008 can be pivotally coupled to the main body 2602 of the surface cleaning head 2600. As such, the linkage 3000 can generally be described as being pivotally coupled to the main body 2602 and the stabilizer 2608. In some instances, the pivot arm opening 3108 can include a bearing to facilitate rotation of the shaft relative to the pivot arm opening 3108.

The pivot arm 3008 can also include a rib 3110 that extends proximate to and radially outward from the pivot arm opening 3108. As shown, the rib 3110 extends between a boss 3112 that extends around the pivot arm opening 3108 and the recess 3004. The rib 3110 can be configured to engage one or more detents configured to retain the linkage in the first and/or second pivot positions.

Figure 32:
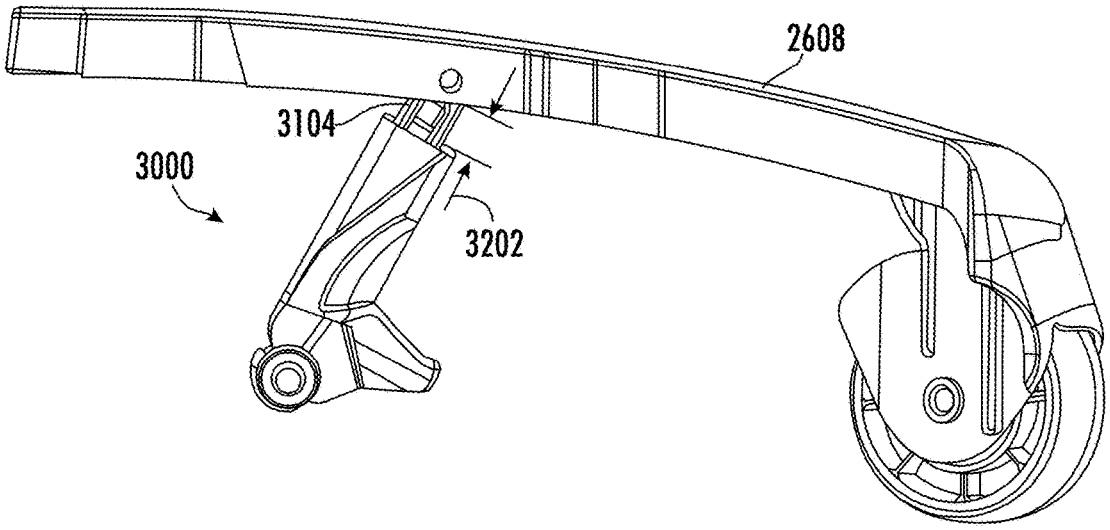
FIG. 32 shows a perspective view of the linkage of FIG. 31 in a first pivot position engaging the stabilizer of FIG. 26, consistent with embodiments of the present disclosure.
Figure 33:
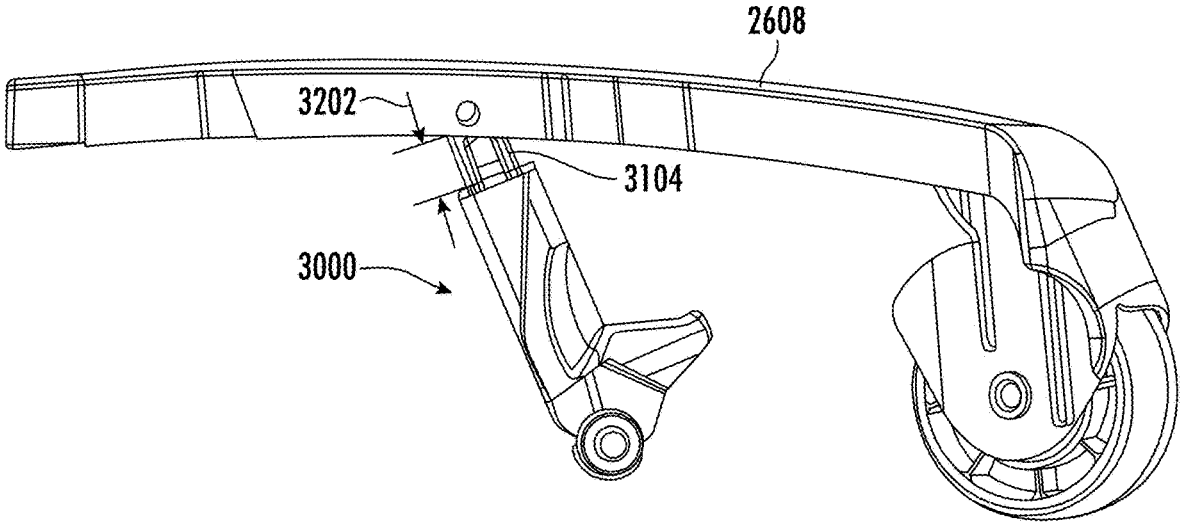
FIG. 33 shows a perspective view of the linkage of FIG. 31 in a second pivot position engaging the stabilizer of FIG. 26, consistent with embodiments of the present disclosure.

FIGS. 32 and 33 show a perspective view of the stabilizer 2608 and a linkage 3000 coupled thereto. As shown, the linkage 3000 is pivotally coupled to the stabilizer 2608. For example, the plunger 3104 can be pivotally coupled to the stabilizer 2608. As also shown, an extension distance 3202 of the plunger 3104 may increase as the stabilizer 2608 transitions from the extended position (e.g., as shown in FIG. 32) to the retracted position (e.g., as shown in FIG. 33).

Figure 34:
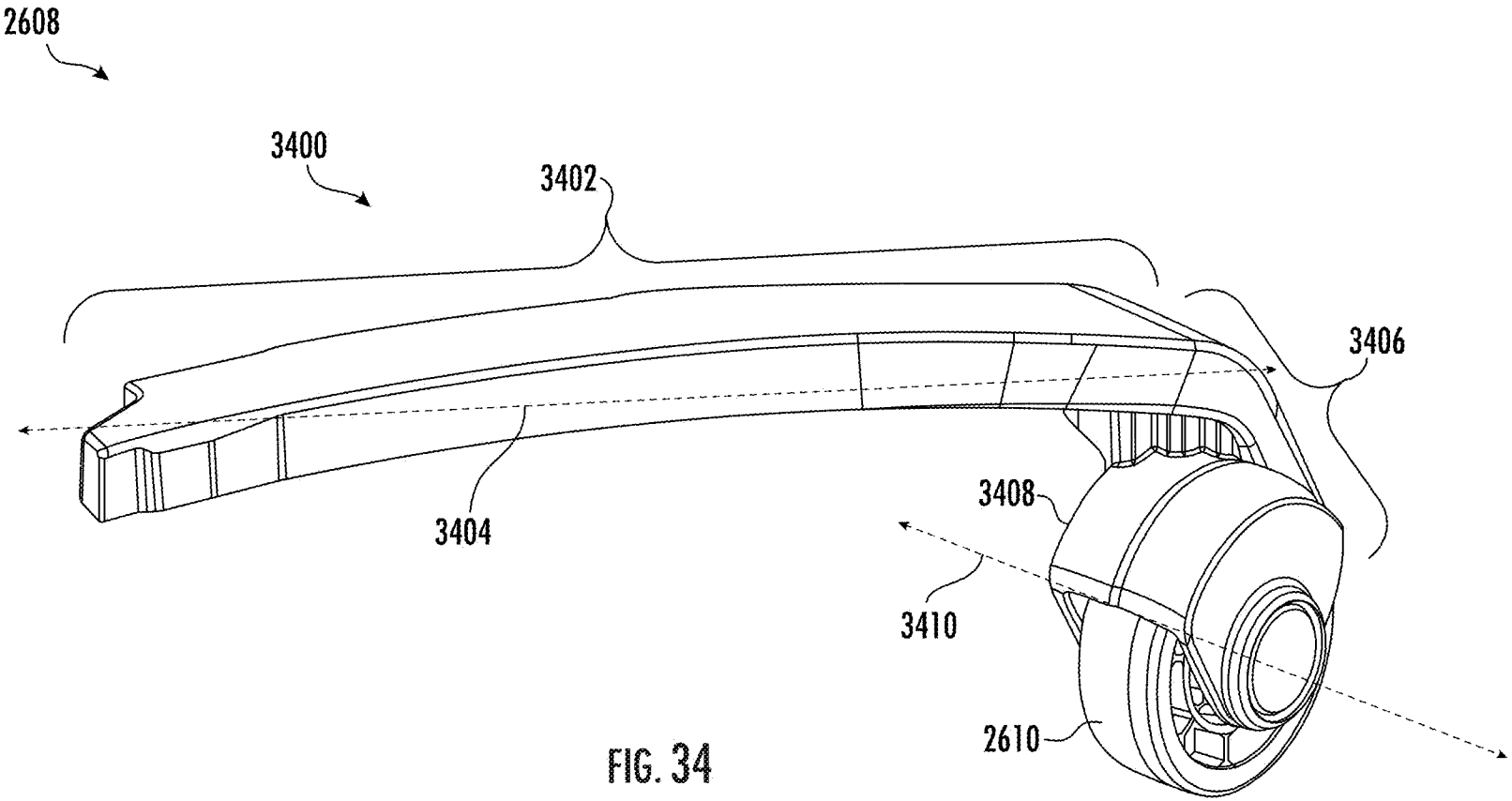
FIG. 34 shows a perspective view of the stabilizer of FIG. 26, consistent with embodiments of the present disclosure.

FIG. 34 shows a perspective view of the stabilizer 2608. As shown, the stabilizer 2608 includes a stabilizer body 3400 pivotally coupled to the stabilizer wheel 2610. The stabilizer body 3400 includes a longitudinal portion 3402 that extends along a stabilizer longitudinal axis 3404 of the stabilizer 2608 and a wheel coupling portion 3406 that extends in a direction transverse to the stabilizer longitudinal axis 3404. In some instances, the longitudinal portion 3402 can have an arcuate shape, wherein the concave portion of the arc faces the surface to be cleaned 2616.

The wheel coupling portion 3406 includes a wheel receptacle 3408 configured to receive at least a portion of the stabilizer wheel 2610. As shown, the wheel receptacle 3408 extends at least partially around the stabilizer wheel 2610 and is vertically spaced apart from the longitudinal portion 3402 of the stabilizer body 3400. The stabilizer wheel 2610 is rotatably coupled to the wheel receptacle 3408 such that the stabilizer wheel 2610 rotates about a stabilizer wheel rotation axis 3410. As shown, the wheel receptacle 3408 is configured such that the stabilizer wheel rotation axis 3410 extends transverse to the stabilizer longitudinal axis 3404 at a non-perpendicular angle. Such a configuration may orient the stabilizer wheel 2610 such that the stabilizer wheel rotation axis 3410 is perpendicular to a forward movement direction of the surface cleaning head 2600.

Figure 35:
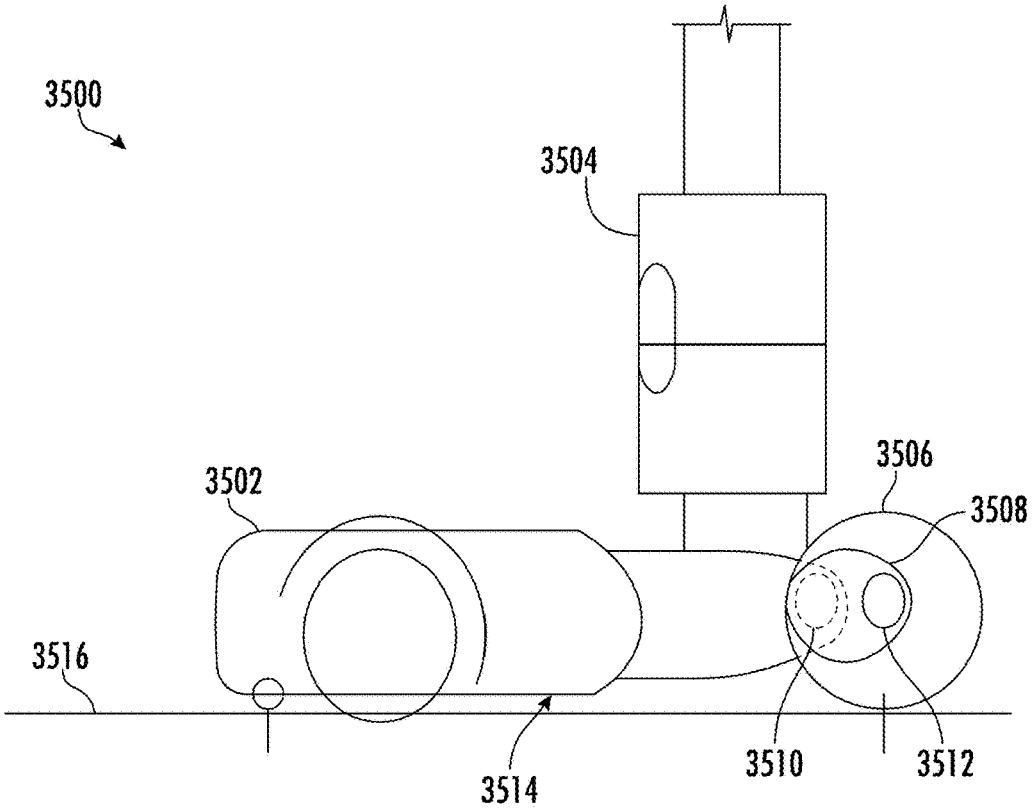
FIG. 35 shows a schematic side view of a surface cleaning head having a stabilizer in an extended position, consistent with embodiments of the present disclosure.
Figure 36:
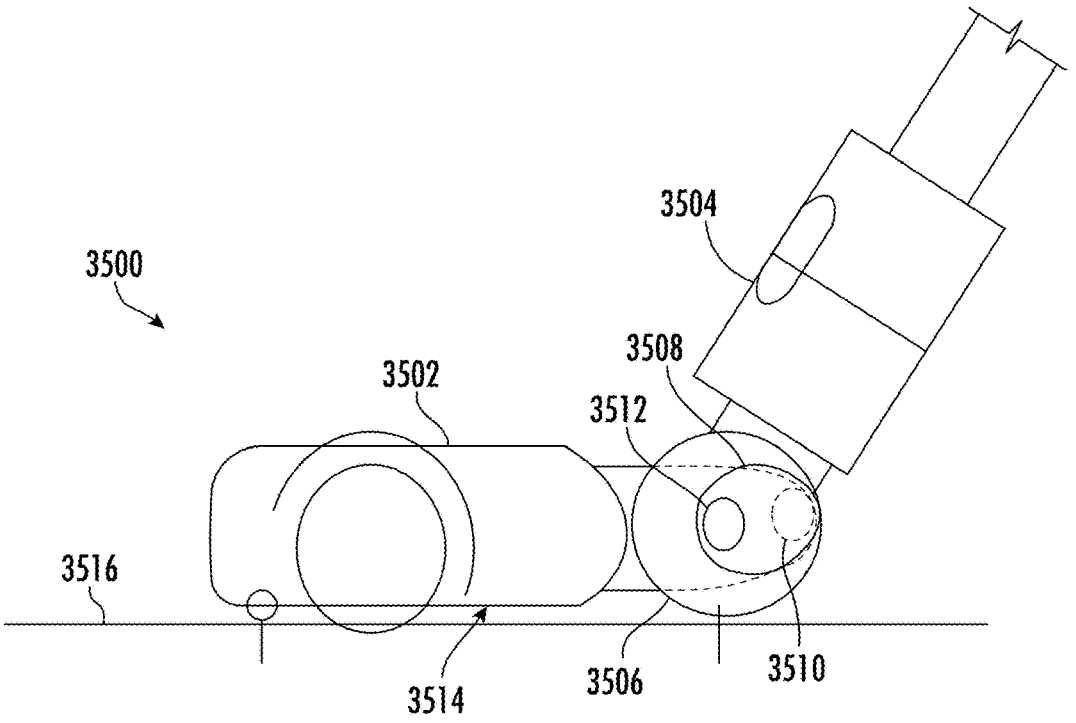
FIG. 36 shows a schematic side view of the surface cleaning head of FIG. 35 having the stabilizer in a retracted position, consistent with embodiments of the present disclosure.

FIGS. 35 and 36 show a schematic view of a surface cleaning head 3500, which may be an example of the surface cleaning head 102 of FIG. 1. As shown, the surface cleaning head 3500 includes a main body 3502, a neck 3504 pivotally coupled to the main body 3502, at least one wheel 3506, and a stabilizer 3508.

As shown, the stabilizer 3508 is pivotally coupled to the main body 3502 of the surface cleaning head 3500 at a first pivot point 3510. As also shown, the at least one wheel 3506 is rotatably coupled to the stabilizer 3508 at a second pivot point 3512. The first pivot point 3510 is spaced apart from the second pivot point 3512 such that, as the stabilizer 3508 rotates about the first pivot point 3510, the at least one wheel transitions between an extended position (e.g., as shown in FIG. 35) and a retracted position (e.g., as shown in FIG. 36) by being rotated around the first pivot point 3510. The stabilizer 3508 can be caused to rotate about the first pivot point 3510 in response to, for example, the neck 3504 being transitioned between a storage position (e.g., as shown in FIG. 35) and an in-use position (e.g., as shown in FIG. 36).

In some instances, and as shown, when transitioning between the extended position and the retracted position, the at least one wheel 3506 can be rotated 180° around the first pivot point 3510 (e.g., in a clockwise or a counter-clockwise direction). Additionally, or alternatively, when transitioning between the extended position and the retracted position the at least one wheel 3506 can be rotated less than or greater than 180° around the first pivot point 3510 (e.g., in a clockwise or a counter-clockwise direction). For example, when in the retracted position, the at least one wheel 3506 can be rotated around the first pivot point 3510 such that a floor facing surface 3514 of the main body 3502 extends transverse to a surface to be cleaned 3516 (e.g., a floor).

Figure 37:
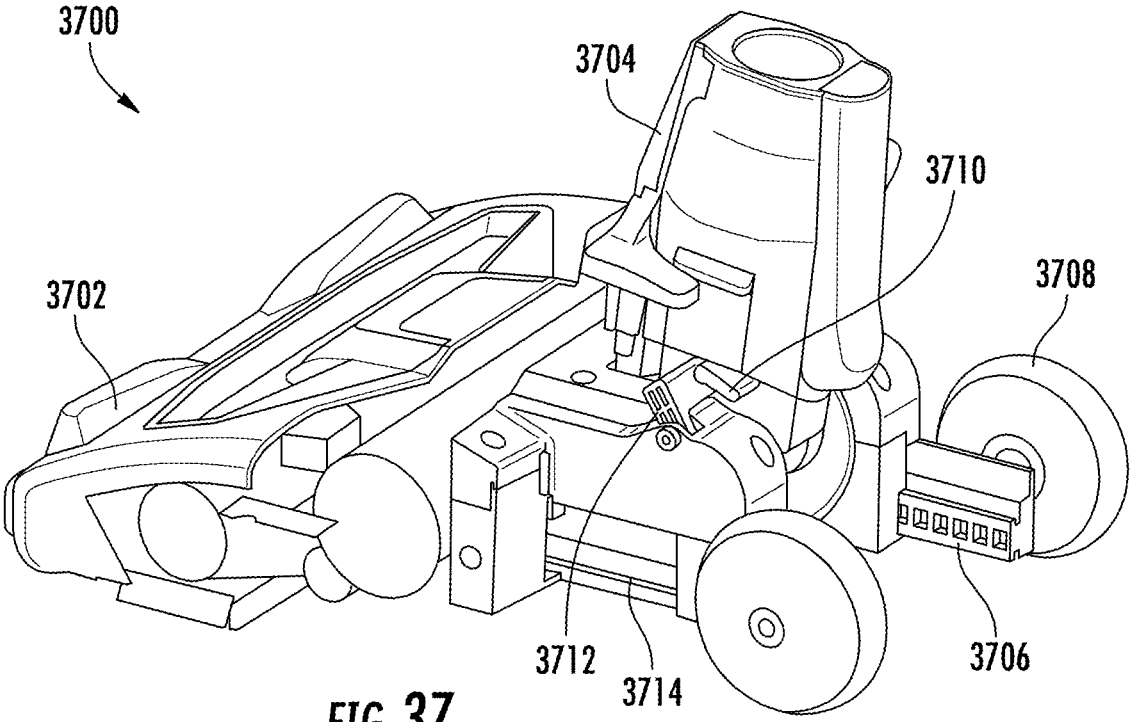
FIG. 37 shows a perspective view of a surface cleaning head having a stabilizer in an extended position, consistent with embodiments of the present disclosure.
Figure 38:
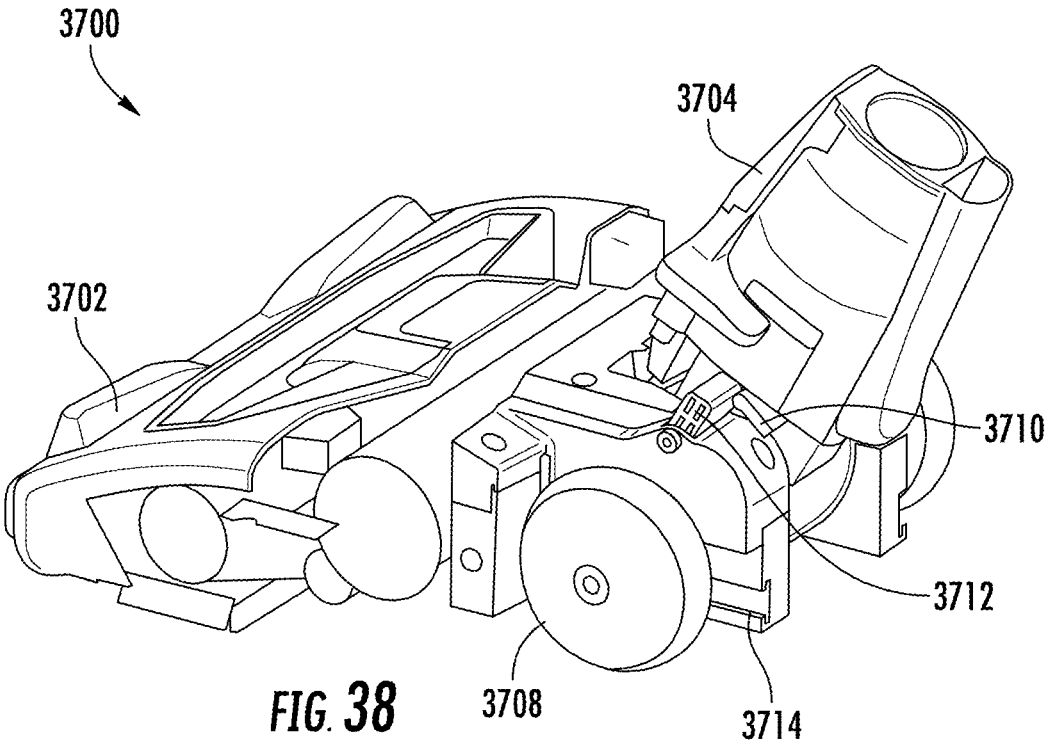
FIG. 38 shows a perspective view of the surface cleaning head of FIG. 37 having the stabilizer in a retracted position, consistent with embodiments of the present disclosure.

FIGS. 37 and 38 show a perspective view of a surface cleaning head 3700, which may be an example of the surface cleaning head 2200 of FIG. 22. As shown, the surface cleaning head 3700 includes a main body 3702, a neck 3704 pivotally coupled to the main body 3702, at least one stabilizer 3706, and at least one wheel 3708 rotatably coupled to the at least one stabilizer 3706. The neck 3704 is configured to pivot side-to-side and between a storage position (e.g., as shown in FIG. 37) and an in-use position (e.g., as shown in FIG. 38). When the neck 3704 transitions from the storage position to the in-use position, the at least one stabilizer 3706 urges the at least one wheel 3708 from an extended position (e.g., as shown in FIG. 37) towards a retracted position (e.g., as shown in FIG. 38).

As shown, the neck 3704 includes at least one protrusion 3710 configured to engage (e.g., contact) a swivel 3712 pivotally coupled to the main body 3702 of the surface cleaning head 3700. The protrusion 3710 is configured to cause the swivel 3712 to pivot in response to the neck 3704 being transitioned between the storage and in-use positions. The swivel 3712 is configured to urge the stabilizer 3706 along a track 3714 such that the at least one wheel 3708 is transitioned between the extended and retracted positions in response to the neck 3704 being transitioned between the storage and in-use positions.

The swivel 3712 can be biased such that the swivel 3712 urges the stabilizer 3706 towards the main body 3702 of the surface cleaning head 3700. In other words, the swivel can be configured to urge the at least one wheel 3708 towards the retracted position. For example, the swivel 3712 can be biased by a spring (e.g., a torsion spring, a compression spring, an extension spring, and/or any other spring).

Figure 39:
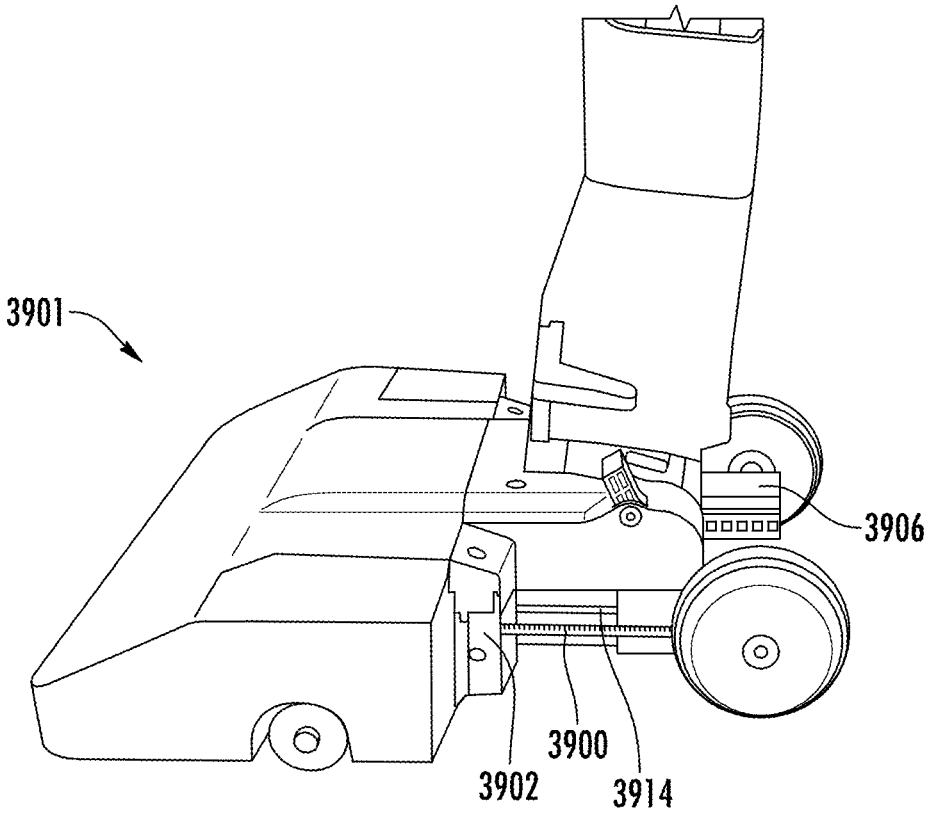
FIG. 39 shows a perspective view of a surface cleaning head having a stabilizer in an extended position, consistent with embodiments of the present disclosure.
Figure 40:
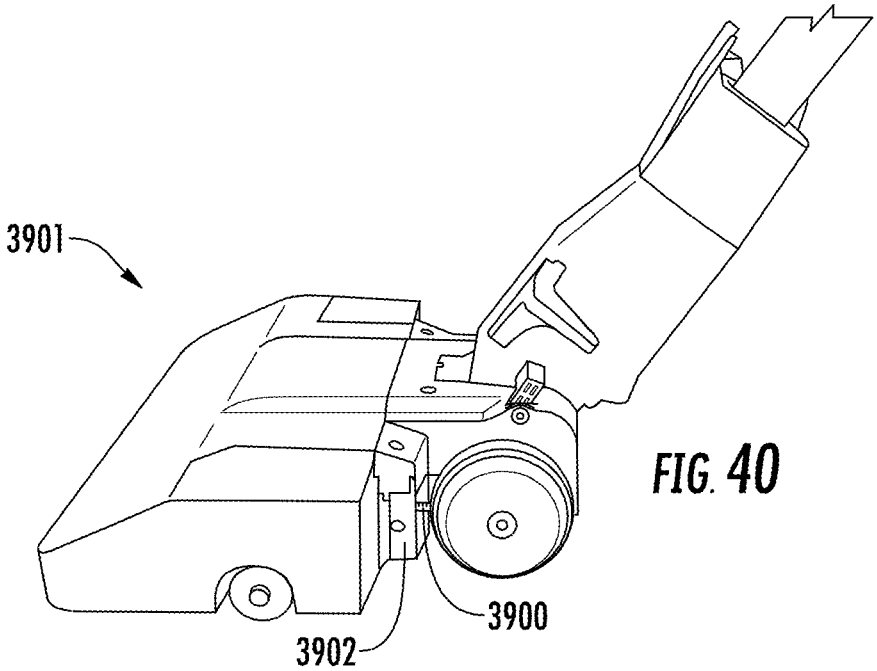
FIG. 40 shows a perspective view of the surface cleaning head of FIG. 39 having the stabilizer in a retracted position, consistent with embodiments of the present disclosure.

Additionally, or alternatively, the stabilizer 3706 can be coupled to a biasing mechanism (e.g., a spring such as a torsion spring, a compression spring, an extension spring, and/or any other spring). For example, as shown in FIGS. 39 and 40, an extension spring 3900 can be coupled to a main body 3902 of a surface cleaning head 3901 and a stabilizer 3906 such that, as the stabilizer 3906 is urged along a track 3914 in a direction away from the main body 3902 of the surface cleaning head 3901, the extension spring 3900 is extended. As the extension spring 3900 extends, the extension spring 3900 exerts a force on the stabilizer 3906 that urges the stabilizer 3906 towards the main body 3902 of the surface cleaning head 3901.

Figure 41:
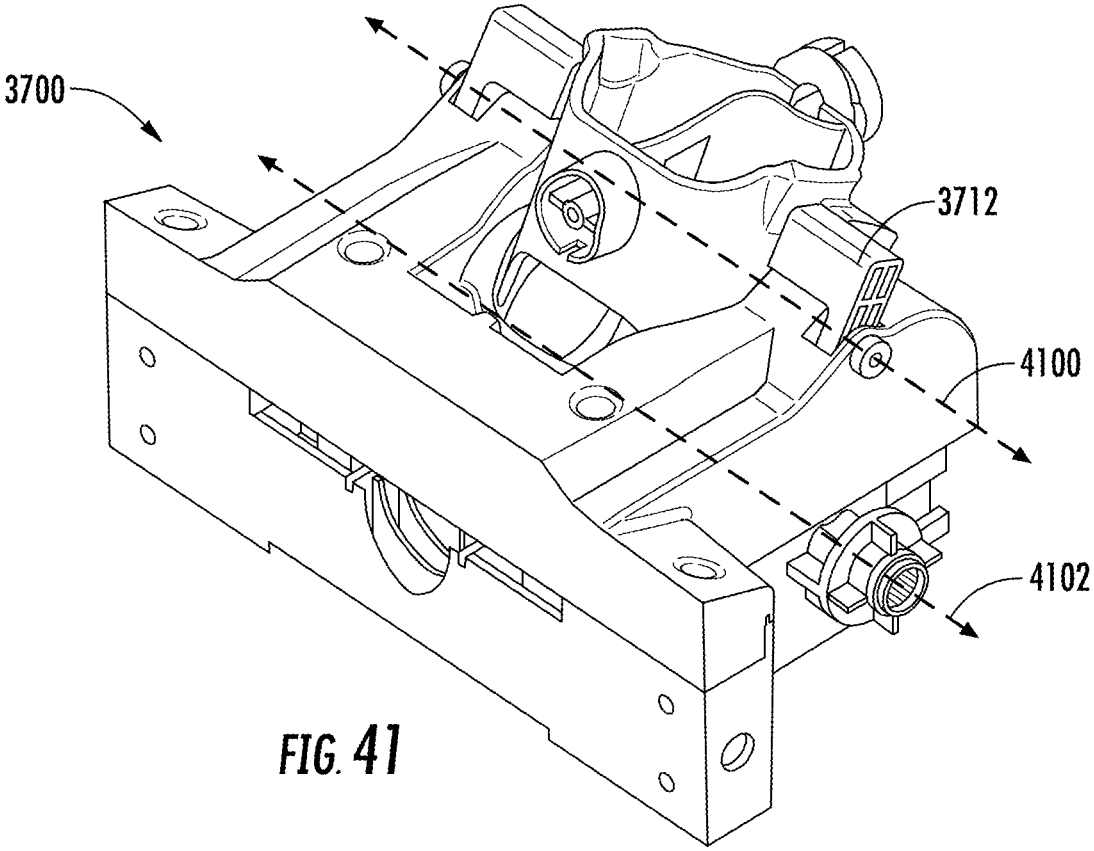
FIG. 41 shows a perspective view of a portion of a main body of the surface cleaning head of FIG. 37, consistent with embodiments of the present disclosure.
Figure 42:
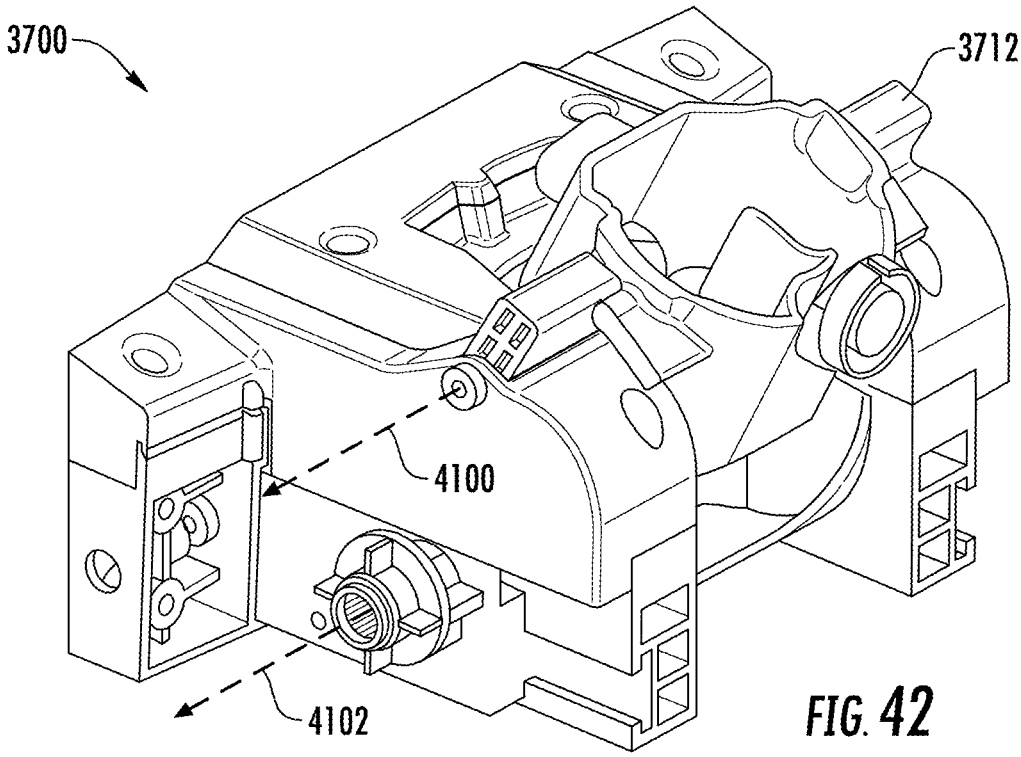
FIG. 42 shows another perspective view of a portion of the main body of FIG. 41, consistent with embodiments of the present disclosure.

FIG. 41 shows a perspective view of a portion of the main body 3702, wherein an upper portion of the main body 3702 is shown as being transparent for purposes of clarity. FIG. 42 shows another perspective view of the portion of the main body 3702 shown in FIG. 41. As shown, the swivel 3712 is configured to pivot about a pivot axis 4100 that extends transverse (e.g., perpendicular) to a direction of forward travel. In other words, the pivot axis 4100 extends substantially parallel to a wheel rotation axis 4102. As shown, the wheel rotation axis 4102 is vertically spaced apart from the pivot axis 4100. In some instances, a torsion spring can be configured to exert a force on the swivel 3712 (e.g., the torsion spring can extend around the wheel rotation axis 4102).

Figure 43:
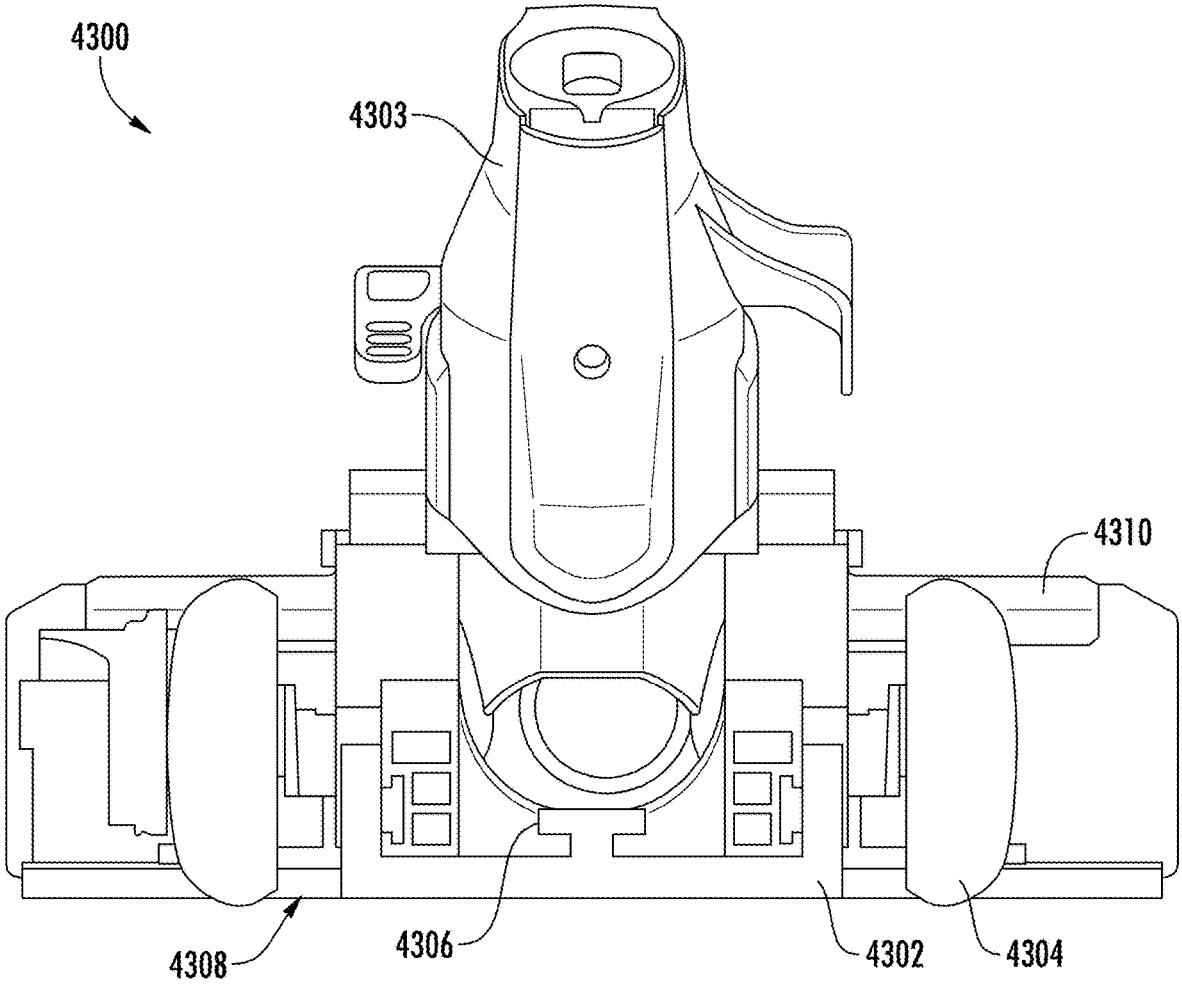
FIG. 43 shows a cross-sectional view of a surface cleaning head, consistent with embodiments of the present disclosure.

FIG. 43 shows a cross-sectional view of a surface cleaning head 4300, which may be an example of the surface cleaning head 102 of FIG. 1. As shown, the surface cleaning head 4300 includes a single stabilizer 4302 having a plurality of wheels 4304 coupled thereto. The stabilizer 4302 is configured to transition between an extended and a retracted position in response to a neck 4303 transitioning between a storage and an in-use position. As shown, the stabilizer 4302 is configured to engage a track 4306 (e.g., a T-slot) that extends along a bottom surface 4308 of the surface cleaning head 4300. In some instances, and as shown, the track 4306 can be defined in a main body 4310 of the surface cleaning head 4300.

Figure 44:
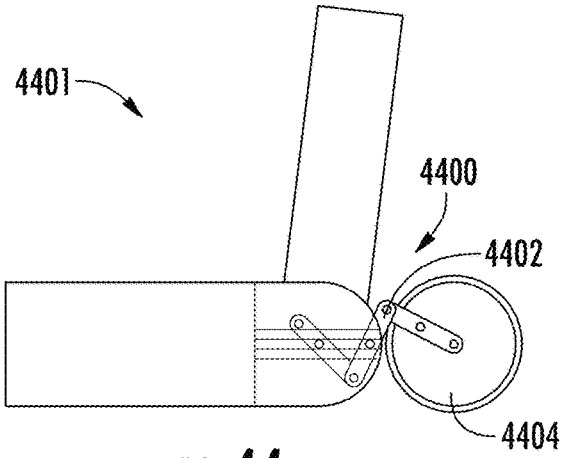
FIG. 44 shows a schematic side view of a surface cleaning head having a stabilizer in an extended position, consistent with embodiments of the present disclosure.
Figure 45:
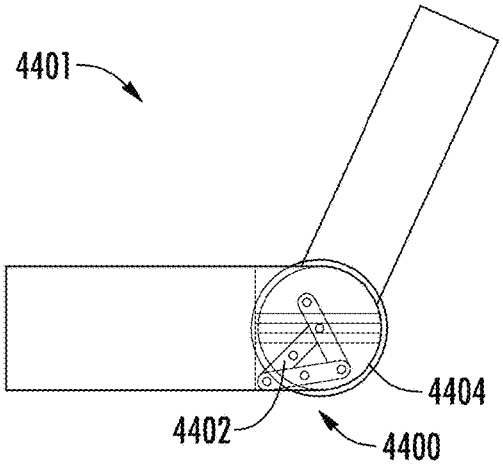
FIG. 45 shows a schematic side view of the surface cleaning head of FIG. 44 having the stabilizer in a retracted position, consistent with embodiments of the present disclosure.

FIGS. 44 and 45 show a schematic view of a surface cleaning head 4401, which may be an example of the surface cleaning head 102 of FIG. 1. As shown, the surface cleaning head 4401 includes a stabilizer 4400 configured to transition between an extended position (e.g., as shown in FIG. 44) and a retracted position (e.g., as shown in FIG. 45). The stabilizer 4400 can include a plurality of links 4402. The links 4402 are pivotally coupled to each other such that stabilizer 4400 can transition between the extended position and the retracted position. As such, the stabilizer 4400 may generally be referred to as being a scissor mechanism. As shown, at least one wheel 4404 is coupled to the stabilizer 4400 (e.g., a distal most one of the plurality of links 4402) such that as the stabilizer 4400 is transitioned between the extended and retracted positions, the wheel 4404 is urged between an extended positioned (e.g., as shown in FIG. 44) and a retracted position (e.g., as shown in FIG. 45).

Figure 46:
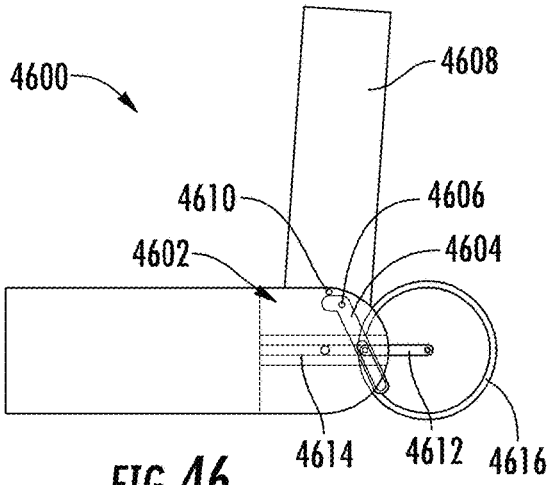
FIG. 46 shows a schematic side view of a surface cleaning head having a stabilizer in an extended position, consistent with embodiments of the present disclosure.
Figure 47:
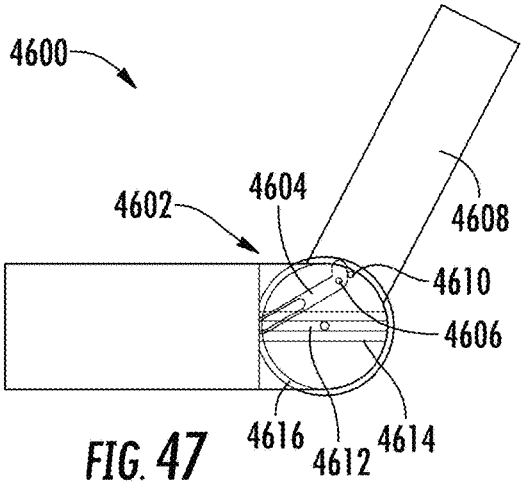
FIG. 47 shows a schematic side view of the surface cleaning head of FIG. 46 having the stabilizer in a retracted position, consistent with embodiments of the present disclosure.

FIGS. 46 and 47 show a schematic view of a surface cleaning head 4600, which may be an example of the surface cleaning head 102 of FIG. 1. As shown, the surface cleaning head 4600 includes a stabilizer 4602 configured to transition between an extended position (e.g., as shown in FIG. 46) and a retracted position (e.g., as shown in FIG. 47). As shown, the stabilizer 4602 includes a lever 4604 configured to pivot about a pivot point 4606 in response to a neck 4608 transitioning between an in-use position (e.g., as shown in FIG. 46) and a storage position (e.g., as shown in FIG. 47). As shown, as the neck 4608 transitions between the in-use and storage positions, a protrusion 4610 coupled to the neck 4608 engages (e.g., contacts) the lever 4604 such that the lever 4604 is caused to pivot about the pivot point 4606. As the lever 4604 pivots, the lever 4604 urges a plunger 4612 along a track 4614. The plunger 4612 can be coupled to at least one wheel 4616 such that the plunger 4612 urges the at least one wheel 4616 between an extended position (e.g., as shown in FIG. 46) and a retracted position (e.g., as shown in FIG. 47).

Figure 48:
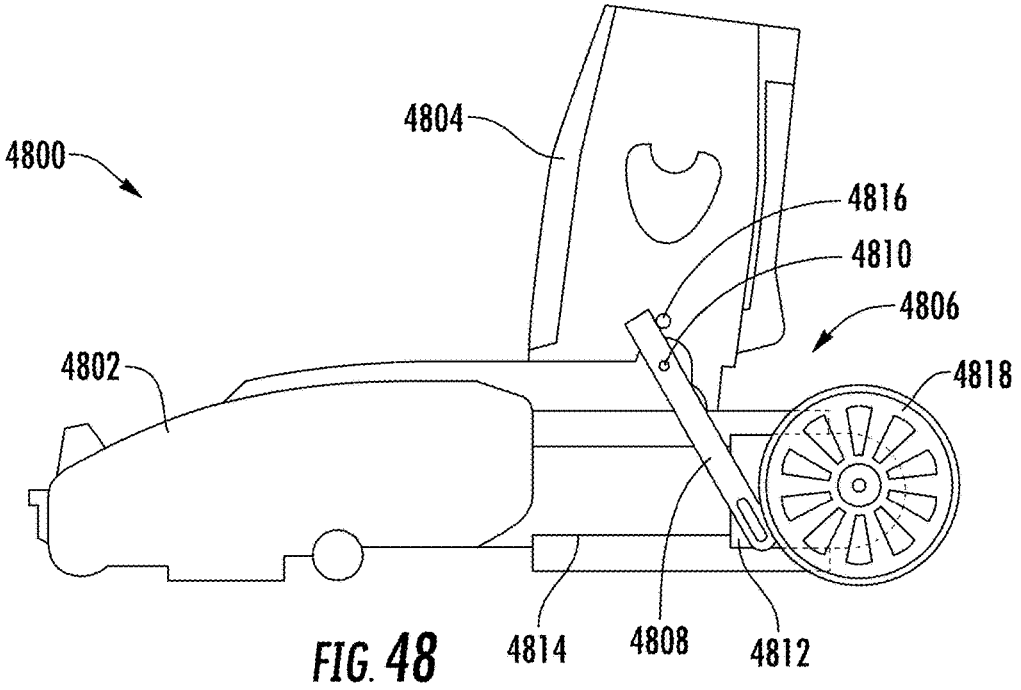
FIG. 48 shows a side view of a surface cleaning head having a stabilizer in an extended position, consistent with embodiments of the present disclosure.

FIG. 48 shows a side view of a surface cleaning head 4800, which may be an example of the surface cleaning head 102 of FIG. 1. As shown, the surface cleaning head 4800 includes a main body 4802, a neck 4804 pivotally coupled to the main body 4802, and a stabilizer 4806 configured to transition between an extended and retracted position. As shown, the stabilizer 4806 includes a pivot arm 4808 pivotally coupled to the main body 4802 such that, as the pivot arm 4808 pivots about a pivot point 4810, the pivot arm 4808 urges a plunger 4812 along a track 4814. The pivot arm 4808 may be biased (e.g., using a spring) such that the pivot arm urges the plunger 4812 towards the main body 4802 of the surface cleaning head 4800. As such, the neck 4804 may include a protrusion 4816 configured to engage (e.g., contact) the pivot arm 4808 such that the plunger 4812 moves along the track 4814 in response to transitioning the neck 4804 between a storage and in-use position. As also shown, at least one wheel 4818 can be coupled to the plunger 4812 such that the at least one wheel 4818 transitions between extended and retracted positions in response to the neck 4804 being transitioned between the storage and in-use positions.

Figure 49:
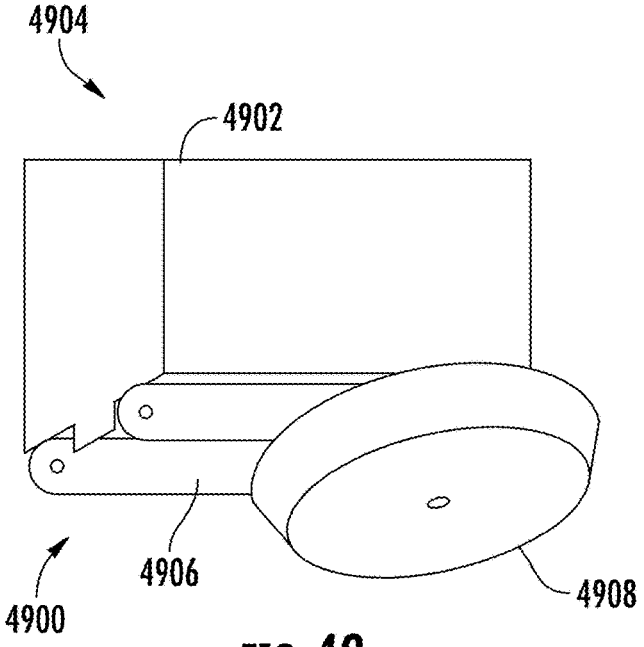
FIG. 49 shows a schematic perspective view of a stabilizer in a retracted position, consistent with embodiments of the present disclosure.
Figure 50:
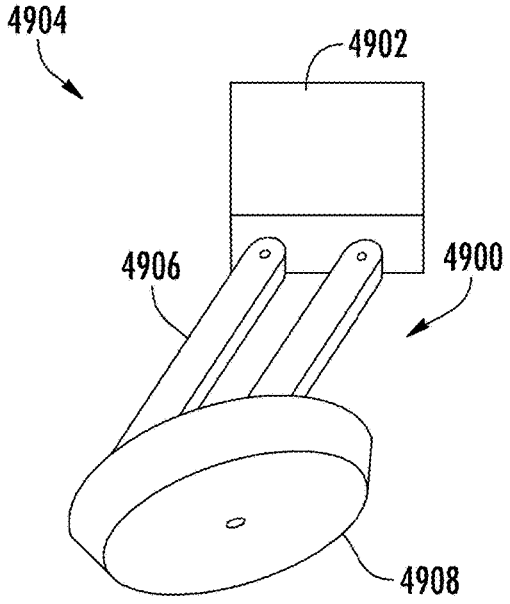
FIG. 50 shows a schematic perspective view of the stabilizer of FIG. 49 in an extended position, consistent with embodiments of the present disclosure.

FIGS. 49 and 50 show a schematic example of a stabilizer 4900, which may be an example of the stabilizer 114 of FIG. 1, coupled to a portion of a main body 4902 of a surface cleaning head 4904. The stabilizer 4900 can include one or more struts 4906 pivotally coupled to the main body 4902 and a wheel 4908. The wheel 4908 can be a main wheel of the surface cleaning head 4904. As shown, when the stabilizer 4900 is in the retracted position (e.g., as shown in FIG. 49) the one or more struts 4906 may extend generally parallel to a surface of the main body 4902 of the surface cleaning head 4904 and, when the stabilizer is in the extended position (e.g., as shown in FIG. 50), the struts 4906 may extend in a direction away from and behind the main body 4902.

Figure 51:
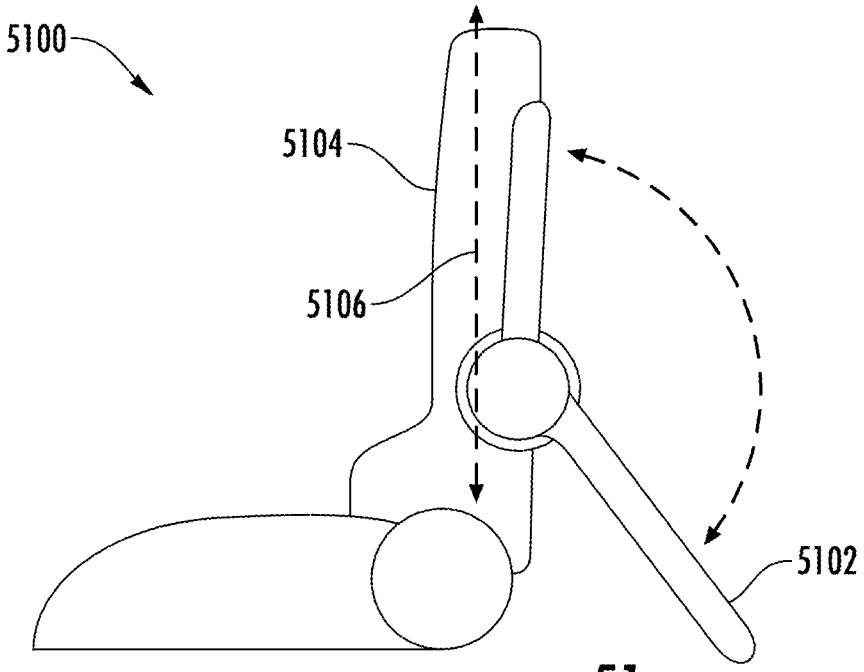
FIG. 51 shows a schematic side view of a surface cleaning head having a stabilizer, consistent with embodiments of the present disclosure.

FIG. 51 shows a schematic example of a surface cleaning head 5100, which may be an example of the surface cleaning head 102 of FIG. 1. As shown, the surface cleaning head 5100 includes a stabilizer 5102 pivotally coupled to a neck 5104 of the surface cleaning head 5100. As shown, the stabilizer 5102 is configured to pivot between an extended and a retracted position (both positions being illustrated in FIG. 51 for purposes of clarity). When in the retracted position, the stabilizer 5102 extends generally parallel to a longitudinal axis 5106 of the neck 5104 and, when in the extended position, the stabilizer 5102 extends in a direction away from the neck 5104 and towards a surface to be cleaned (e.g., a floor). In some instances, the stabilizer 5102 can be configured to be removably coupled to the neck 5104, which may facilitate use of the stabilizer 5102 between multiple surface treatment apparatuses (e.g., vacuum cleaners).

Figure 52:
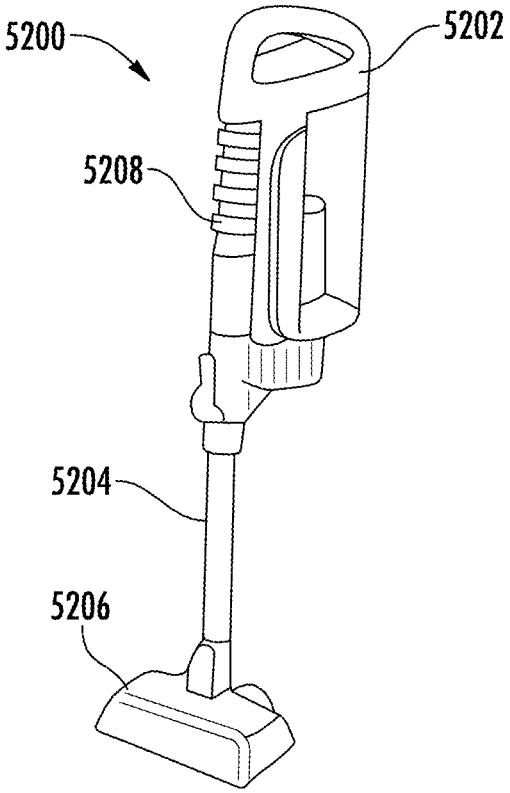
FIG. 52 shows a schematic perspective view of a vacuum cleaner having a stabilizing system in a first position, consistent with embodiments of the present disclosure.
Figure 53:
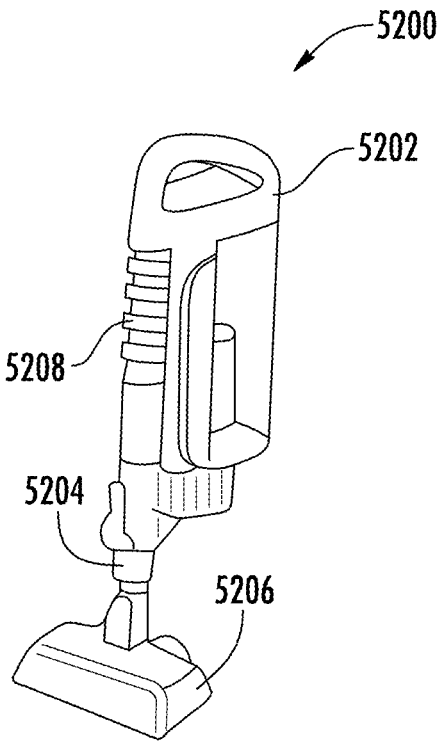
FIG. 53 shows a schematic perspective view of the vacuum cleaner of FIG. 52 having the stabilizing system in a second position, consistent with embodiments of the present disclosure.

FIGS. 52 and 53 show a schematic view of an example of a stabilizing system configured to improve the stability of a vacuum cleaner 5200. As shown, a suction body 5202 (e.g., having a suction motor and dust cup) of the vacuum cleaner 5200 is configured to slide along a wand 5204 in a direction of a surface cleaning head 5206 such that a location of a center of mass of the vacuum cleaner can be positioned closer to the surface cleaning head 5206. As shown, the wand 5204 can be received at least partially within a flexible hose 5208. The flexible hose 5208 extends along the suction body 5202.

An example of a surface cleaning head may include a main body, a neck pivotally coupled to the main body, a stabilizer, and a linkage pivotally coupled to the main body and the stabilizer. The linkage may be configured to cause the stabilizer to transition between an extended position and a retracted position in response to a pivotal movement of the neck.

In some instances, the neck may include a protrusion configured to engage at least a portion of the linkage. The protrusion may be configured to urge the linkage to pivot in response to the pivotal movement of the neck. In some instances, the linkage may include a pivot arm and a plunger. The pivot arm may define a channel for receiving the plunger. In some instances, the plunger is configured to slide within the channel in response to the pivotal movement of the neck. In some instances, the stabilizer may include a wheel. In some instances, the surface cleaning head includes a plurality of stabilizers, wherein each stabilizer extends along a respective one of a first axis and a second axis. In some instances, the first axis may extend transverse to the second axis such that a separation distance between the stabilizers increases with increasing distance from the main body. In some instances, the main body may include an opening from which the stabilizer extends. In some instances, the opening may be disposed between a top surface of the main body and a main wheel. In some instances, at least a portion of the stabilizer may extend over at least a portion of the main wheel.

An example of a vacuum cleaner may include a wand and a surface cleaning head. The surface cleaning head may include a main body, a neck, a stabilizer, and a linkage. The neck may be configured to receive the wand. The neck may be pivotally coupled to the main body such that the wand is configured to transition between a storage position and an in-use position. The linkage may be pivotally coupled to the main body and the stabilizer. The linkage may be configured to cause the stabilizer to transition between an extended position and a retracted position in response to a pivotal movement of the neck.

In some instances, the neck may include a protrusion configured to engage at least a portion of the linkage. The protrusion may be configured to urge the linkage to pivot in response to the pivotal movement of the neck. In some instances, the linkage may include a pivot arm and a plunger. The pivot arm may define a channel for receiving the plunger. In some instances, the plunger may be configured to slide within the channel in response to the pivotal movement of the neck. In some instances, the stabilizer may include a wheel. In some instances, the surface cleaning head may include a plurality of stabilizers, wherein each stabilizer extends along a respective one of a first axis and a second axis. In some instances, the first axis may extend transverse to the second axis such that a separation distance between the stabilizers increases with increasing distance from the main body. In some instances, the main body may include an opening from which the stabilizer extends. In some instances, the opening may be disposed between a top surface of the main body and a main wheel. In some instances, at least a portion of the stabilizer may extend over at least a portion of the main wheel.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A surface cleaning head comprising:

a main body;

a neck pivotally connected to the main body and configured to transition between a storage position and an in-use position;

a first and a second main wheel rotatably coupled to the main body on opposing sides of the neck, the first and second main wheels configured to support the surface cleaning head on a surface to be cleaned;

a first stabilizer coupled to the main body and configured to move along a first stabilizer axis that intersects the surface to be cleaned; and a second stabilizer coupled to the main body and configured to move along a second stabilizer axis that intersects the surface to be cleaned, the second stabilizer axis extending transverse to the first stabilizer axis such that a separation distance between the first and second stabilizers increases with increasing distance from the main body, wherein:

when transitioning the neck from the storage position to the in-use position, the first and second stabilizers move towards the main body along the first and second stabilizer axes, respectively; and when transitioning the neck from the in-use position to the storage position, the first and second stabilizers move away from the main body along the first and second stabilizer axes, respectively.

2. The surface cleaning head of claim 1, wherein the main body includes a first stabilizer opening from which the first stabilizer extends and a second stabilizer opening from which the second stabilizer extends.

3. The surface cleaning head of claim 2, wherein the first and second stabilizer openings are disposed above the first and second main wheels, respectively.

4. The surface cleaning head of claim 3, wherein at least a portion of the first and second stabilizers extend over at least a portion of the first and second main wheels, respectively.

5. The surface cleaning head of claim 1, wherein the first stabilizer includes a first stabilizer wheel and the second stabilizer includes a second stabilizer wheel.

6. The surface cleaning head of claim 5, wherein, when the neck is in the in-use position, the first and second stabilizer wheels are out of engagement with the surface to be cleaned and, when the neck is in the storage position, the first and second stabilizer wheels are in engagement with the surface to be cleaned.

7. The surface cleaning head of claim 6, wherein, when the first and second stabilizer wheels are in engagement with the surface to be cleaned, the first main wheel is disposed between the first stabilizer wheel and a forward portion of the main body and the second main wheel is disposed between the second stabilizer wheel and the forward portion of the main body.

8. The surface cleaning head of claim 1 further comprising a first linkage configured to urge the first stabilizer to move along the first stabilizer axis and a second linkage configured to urge the second stabilizer to move along the second stabilizer axis.

9. The surface cleaning head of claim 8, wherein the first and second linkages are pivotally coupled with the main body and configured to cooperate with the neck to urge the first and second stabilizers to move.

10. The surface cleaning head of claim 9, wherein the first linkage is pivotally coupled to the first stabilizer and the second linkage is pivotally coupled to the second stabilizer.

11. A surface cleaning device comprising:

a wand; and a surface cleaning head, the surface cleaning head including:

a main body;

a neck pivotally connected to the main body and configured to receive the wand, the neck being further configured to transition between a storage position and an in-use position;

a first and a second main wheel rotatably coupled to the main body on opposing sides of the neck, the first and second main wheels configured to support the surface cleaning head on a surface to be cleaned;

a first stabilizer coupled to the main body and configured to move along a first stabilizer axis that intersects the surface to be cleaned; and a second stabilizer coupled to the main body and configured to move along a second stabilizer axis that intersects the surface to be cleaned, the second stabilizer axis extending transverse to the first stabilizer axis such that a separation distance between the first and second stabilizers increases with increasing distance from the main body, wherein:

when transitioning the neck from the storage position to the in-use position, the first and second stabilizers move towards the main body along the first and second stabilizer axes, respectively; and when transitioning the neck from the in-use position to the storage position, the first and second stabilizers move away from the main body along the first and second stabilizer axes, respectively.

12. The surface cleaning device of claim 11, wherein the main body includes a first stabilizer opening from which the first stabilizer extends and a second stabilizer opening from which the second stabilizer extends.

13. The surface cleaning device of claim 12, wherein the first and second stabilizer openings are disposed above the first and second main wheels, respectively.

14. The surface cleaning device of claim 13, wherein at least a portion of the first and second stabilizers extend over at least a portion of the first and second main wheels, respectively.

15. The surface cleaning device of claim 11, wherein the first stabilizer includes a first stabilizer wheel and the second stabilizer includes a second stabilizer wheel.

16. The surface cleaning device of claim 15, wherein, when the neck is in the in-use position, the first and second stabilizer wheels are out of engagement with the surface to be cleaned and, when the neck is in the storage position, the first and second stabilizer wheels are in engagement with the surface to be cleaned.

17. The surface cleaning device of claim 16, wherein, when the first and second stabilizer wheels are in engagement with the surface to be cleaned, the first main wheel is disposed between the first stabilizer wheel and a forward portion of the main body and the second main wheel is disposed between the second stabilizer wheel and the forward portion of the main body.

18. The surface cleaning device of claim 11 further comprising a first linkage configured to urge the first stabilizer to move along the first stabilizer axis and a second linkage configured to urge the second stabilizer to move along the second stabilizer axis.

19. The surface cleaning device of claim 18, wherein the first and second linkages are pivotally coupled with the main body and configured to cooperate with the neck to urge the first and second stabilizers to move.

20. The surface cleaning device of claim 19, wherein the first linkage is pivotally coupled to the first stabilizer and the second linkage is pivotally coupled to the second stabilizer.

* * * * *